US010492613B2

(12) United States Patent
LaPointe et al.

(10) Patent No.: US 10,492,613 B2
(45) Date of Patent: Dec. 3, 2019

(54) LEGREST MECHANISM FOR FURNITURE MEMBER

(71) Applicant: La-Z-Boy Incorporated, Monroe, MI (US)

(72) Inventors: Larry P. LaPointe, Temperance, MI (US); Chad E. Adams, Perrysburg, OH (US); Gerald G. Stotz, Ida, MI (US)

(73) Assignee: La-Z-Boy Incorporated, Monroe, MI (US)

( * ) Notice: Subject to any disclaimer, the term of this patent is extended or adjusted under 35 U.S.C. 154(b) by 134 days.

(21) Appl. No.: 15/709,804

(22) Filed: Sep. 20, 2017

(65) Prior Publication Data

US 2019/0082849 A1 Mar. 21, 2019

(51) Int. Cl.
*A47C 7/50* (2006.01)
*A47C 7/56* (2006.01)
(Continued)

(52) U.S. Cl.
CPC ..... *A47C 7/506* (2013.01); *A47C 1/023* (2013.01); *A47C 1/024* (2013.01); *A47C 1/0242* (2013.01);
(Continued)

(58) Field of Classification Search
CPC ..... A47C 7/506; A47C 7/563; A47C 7/50; A47C 1/024; A47C 1/032; A47C 1/035; A47C 1/0355; A47C 3/02
(Continued)

(56) References Cited

U.S. PATENT DOCUMENTS 1,510,858 A 10/1924 Nadell et al.
2,473,895 A 6/1949 Mednick
(Continued)

FOREIGN PATENT DOCUMENTS

CN 200976974 Y 11/2007
DE 623960 C 1/1936
(Continued)

OTHER PUBLICATIONS

International Search Report for Application No. PCT/US2016/032967 dated Aug. 19, 2016.
(Continued)

*Primary Examiner* — Mark R Wendell
(74) *Attorney, Agent, or Firm* — Harness, Dickey & Pierce, P.L.C.

(57) ABSTRACT

A furniture member may include a seat assembly and a legrest assembly. The seat assembly includes a seat bottom and a seatback. The legrest assembly may include a legrest platform and articulating arm assemblies. Each articulating arm assembly may include first and second link-housings and first and second control links. The first link-housings may be rotatably attached to the seat bottom. The second link-housings may be rotatably attached to respective first link-housings and the legrest platform. The first control links may be disposed within respective first link-housings. Rotation of the first link-housings relative to the seat bottom may cause relative movement between the first control links and the first link-housings and relative movement between the first control links and the second link-housings. The second control links may be disposed at least partially within respective second link-housings and may be movably coupled to the second link-housings and to the legrest platform.

34 Claims, 32 Drawing Sheets

(51) Int. Cl.
*A47C 1/024* (2006.01)
*A47C 1/023* (2006.01)
*A47C 3/18* (2006.01)
*A47C 3/20* (2006.01)

(52) U.S. Cl.
CPC ..... *A47C 3/18* (2013.01); *A47C 3/20* (2013.01); *A47C 7/5068* (2018.08); *A47C 7/563* (2013.01)

(58) Field of Classification Search
USPC ..... 297/325
See application file for complete search history.

(56) References Cited

U.S. PATENT DOCUMENTS

| | | | | |
|---|---|---|---|---|
| 2,719,572 | A | 10/1955 | Goldberg | |
| 3,179,466 | A | 4/1965 | Garrett | |
| 3,191,990 | A | 6/1965 | Rugg et al. | |
| 3,865,432 | A | 2/1975 | Rogers, Jr. et al. | |
| 3,880,462 | A | 4/1975 | Mednick | |
| 3,926,472 | A | 12/1975 | Evans | |
| 4,216,991 | A | 8/1980 | Holobaugh | |
| 4,216,992 | A | 8/1980 | Crum | |
| 4,364,603 | A | 12/1982 | Johnson | |
| 4,429,917 | A | 2/1984 | Diffrient | |
| 4,805,960 | A | 2/1989 | Tacker | |
| 4,815,789 | A | 3/1989 | Marcus | |
| 4,861,101 | A | 8/1989 | Hartline | |
| 5,011,220 | A | 4/1991 | LaPointe | |
| 5,064,244 | A | 11/1991 | Sproule | |
| 5,123,705 | A | 6/1992 | Johnson | |
| 5,147,108 | A | 9/1992 | LaPointe | |
| 5,217,276 | A | 6/1993 | LaPointe et al. | |
| 5,234,253 | A | 8/1993 | LaPointe et al. | |
| 5,253,922 | A | 10/1993 | Corlett | |
| 5,360,255 | A | 11/1994 | Cook et al. | |
| 5,419,615 | A | 5/1995 | Dozsa-Farkas | |
| 5,480,213 | A | 1/1996 | Sproule | |
| 5,556,163 | A | 9/1996 | Rogers, III et al. | |
| 5,570,927 | A | 11/1996 | LaPointe et al. | |
| 5,857,739 | A | 1/1999 | Smith | |
| 5,975,627 | A | 11/1999 | LaPointe et al. | |
| 5,992,931 | A * | 11/1999 | LaPointe | A47C 1/0345 297/330 |
| 6,488,332 | B1 | 12/2002 | Markwald | |
| 6,491,342 | B1 | 12/2002 | Smith | |
| 7,261,367 | B2 | 8/2007 | Duncan et al. | |
| 7,637,571 | B2 | 12/2009 | Okano et al. | |
| 7,828,380 | B2 | 11/2010 | Olarte | |
| 7,967,383 | B2 | 6/2011 | LaPointe | |
| 7,992,937 | B2 | 8/2011 | Plikat et al. | |
| 8,517,463 | B2 | 8/2013 | Murphy et al. | |
| 8,616,627 | B2 | 12/2013 | Murphy et al. | |
| 8,882,190 | B2 | 11/2014 | Garland | |
| 9,239,129 | B2 | 1/2016 | Yamamoto et al. | |
| 9,326,608 | B1 | 5/2016 | Hoy et al. | |
| 9,358,167 | B2 | 6/2016 | LaPointe et al. | |
| 9,433,295 | B2 | 9/2016 | Crum | |
| 9,808,090 | B2 | 11/2017 | Carrera | |
| 10,092,106 | B2 | 10/2018 | LaPointe et al. | |
| 10,285,502 | B2 | 5/2019 | LaPointe et al. | |
| 2006/0249992 | A1 | 11/2006 | LaPointe et al. | |
| 2008/0150329 | A1 | 6/2008 | Lawson | |
| 2009/0218863 | A1 | 9/2009 | LaPointe et al. | |
| 2011/0248544 | A1 | 10/2011 | Adams et al. | |
| 2011/0248547 | A1 * | 10/2011 | LaPointe | A47C 1/0355 297/85 R |
| 2012/0025575 | A1 | 2/2012 | Lin | |
| 2012/0112517 | A1 | 5/2012 | Hoffman et al. | |
| 2012/0193946 | A1 | 8/2012 | Robertson | |
| 2014/0049084 | A1 | 2/2014 | Lawson et al. | |
| 2014/0103688 | A1 | 4/2014 | Wilson | |
| 2014/0312660 | A1 | 10/2014 | Natuzzi et al. | |
| 2015/0076891 | A1 * | 3/2015 | LaPointe | A47C 31/008 297/85 M |
| 2015/0250320 | A1 | 9/2015 | Arceci et al. | |
| 2015/0272329 | A1 | 10/2015 | Lawson | |
| 2015/0282619 | A1 | 10/2015 | Lawson | |
| 2016/0022039 | A1 | 1/2016 | Paul et al. | |
| 2016/0058191 | A1 * | 3/2016 | Hegedus | A47C 7/506 297/330 |
| 2016/0058195 | A1 | 3/2016 | Huang et al. | |
| 2016/0206099 | A1 | 7/2016 | Robertson | |
| 2016/0256342 | A1 | 9/2016 | Alvarez et al. | |
| 2016/0302573 | A1 | 10/2016 | Garland et al. | |
| 2016/0376007 | A1 | 12/2016 | Meindlhumer | |
| 2017/0013961 | A1 | 1/2017 | LaPointe et al. | |
| 2017/0042330 | A1 | 2/2017 | Bruce et al. | |
| 2018/0070725 | A1 | 3/2018 | LaPointe et al. | |
| 2018/0206643 | A1 | 7/2018 | Cebulsky | |
| 2018/0289156 | A1 | 10/2018 | Marshall et al. | |
| 2018/0289157 | A1 | 10/2018 | Marshall et al. | |
| 2018/0289158 | A1 | 10/2018 | Marshall et al. | |
| 2019/0082841 | A1 | 3/2019 | LaPointe et al. | |
| 2019/0082843 | A1 | 3/2019 | LaPointe et al. | |

FOREIGN PATENT DOCUMENTS

| | | | |
|---|---|---|---|
| JP | 2001054443 | A | 2/2001 |
| KR | 101245357 | B1 | 3/2013 |
| TW | 411808 | U | 11/2000 |

OTHER PUBLICATIONS

Written Opinion of the International Searching Authority for Application No. PCT/US2016/032967 dated Aug. 19, 2016.
International Search Report for Application No. PCT/US2018/051787 dated Jan. 10, 2019.
Written Opinion of the International Searching Authority for Application No. PCT/US2018/051787 dated Jan. 10, 2019.
International Search Report for Application No. PCT/US2018/025467, dated Jul. 17, 2018.
Written Opinion of the International Searching Authority for Application No. PCT/US2018/025467, dated Jul. 17, 2018.
European Search Report for Application No. 18159817.8, dated Sep. 26, 2018.
European Search Report for Application No. 16824840.9, dated Dec. 7, 2018.
First Examination Report for New Zealand Application No. 738919, dated Mar. 14, 2019.
Office Action for Taiwanese Application No. 107128557, dated Jun. 14, 2019. Translation provided by Lee and Li, Attorneys-at-Law.
Office Action for Taiwanese Application No. 107128560, dated Jun. 18, 2019. Translation provided by Lee and Li, Attorneys-at-Law.
Office Action for Taiwanese Application No. 107128558, dated Jun. 19, 2019. Translation provided by Lee and Li, Attorneys-at-Law.
Office Action for Taiwanese Application No. 107128559, dated Jun. 21, 2019. Translation provided by Lee and Li, Attorneys-at-Law.

* cited by examiner

LEGREST MECHANISM FOR FURNITURE MEMBER

FIELD

The present disclosure relates to a furniture member, and more particularly, to a legrest mechanism for a furniture member.

BACKGROUND

This section provides background information related to the present disclosure and is not necessarily prior art.

Furniture members such as chairs, sofas, loveseats, sectionals, and the like can include a mechanism that allows an occupant of the furniture member to move a legrest panel or platform from a stowed or retracted position to a deployed or extended position to support the legs and/or feet of the occupant. Such furniture members can include a tilting seat assembly and a reclining seatback. Other furniture members can include a rocking seat assembly or a swiveling seat assembly. The present disclosure provides a furniture member with such functionality and other functionalities to allow the occupant of the furniture member to move the furniture member into various positions and configurations, as desired, to improve the occupant's comfort and enjoyment of the furniture member.

SUMMARY

This section provides a general summary of the disclosure, and is not a comprehensive disclosure of its full scope or all of its features.

The present disclosure provides a furniture member that may include a seat assembly and a legrest assembly. The seat assembly may include a seat bottom and a seatback. The legrest assembly may include a legrest platform, a push bar and a pair of articulating arm assemblies. Each of the articulating arm assemblies may include a first link-housing, a second link-housing, a first control link, and a second control link. The first link-housings may be fixedly attached to the push bar and are rotatably attached to the seat bottom. Each of the second link-housings may be rotatably attached to a respective one of the first link-housings. The second link-housings may be rotatably attached to the legrest platform. Each of the first control links may be disposed within a respective one of the first link-housings. Rotation of the first link-housings relative to the seat bottom may cause relative movement between the first control links and the first link-housings and relative movement between the first control links and the second link-housings. Each of the second control links may be disposed at least partially within a respective one of the second link-housings. The second control links may be movably coupled to the second link-housings and movably coupled to the legrest platform.

In some configurations, the seat assembly includes armrest members. The seat bottom may be disposed between the armrest members and may be movable relative to the armrest members. In some configurations, a distance between the legrest platform and a front frame member of the seat bottom does not change in response to movement of the seat bottom relative to the armrest members.

In some configurations, the distance between the legrest platform and the front frame member of the seat bottom does not change in response to movement of the seatback relative to the armrest members and the seat bottom.

In some configurations, the legrest assembly is mounted to the seat bottom such that the entire legrest assembly is allowed to move with the seat bottom relative to the armrest members while remaining fixed relative to the seat bottom.

In some configurations, the furniture member includes a base assembly supporting the seat assembly. The seat bottom may be movable relative to the base assembly. In some configurations, the distance between the legrest platform and the front frame member of the seat bottom does not change in response to movement of the seat bottom relative to the base assembly.

In some configurations, each of the first control links are rotatably attached to a first lug member that is at least partially disposed within the respective first link-housing. The first lug member may be fixed relative to the seat bottom.

In some configurations, each of the first control links are rotatably attached to a second lug member that is at least partially disposed within the respective first link-housing. The second lug member may be fixed relative to the respective second link-housing.

In some configurations, each first link-housing includes a first joint-bearing-surface that encircles the respective second lug member. Each second link-housing may include a second joint-bearing-surface that encircles the respective second lug member and rotatably engages the first joint-bearing surface. The first and second joint-bearing-surfaces may be flat, annular surfaces that cooperate with each other to restrict side-to-side movement of the legrest assembly relative to the seat assembly.

In some configurations, the first link-housing includes a third joint-bearing-surface that encircles a rotational axis about which the first link-housing rotates relative to a seat attachment bracket fixed to the seat bottom.

In some configurations, one end of each second control link is rotatably attached to a platform bracket that is fixed to the legrest platform.

In some configurations, another end of each second control link includes a pin that is slidably received in an arcuate slot formed in the respective second link-housing.

In some configurations, the arcuate slot curves partially around a rotational axis about which the second link-housing rotates relative to the first link-housing.

In some configurations, the first link-housings are rotatably attached to brackets fixedly mounted on a front frame member of the seat bottom.

In some configurations, each seat attachment bracket is coupled to a first lug member by a first keyed shaft. The first control link may be rotatably attached to the first lug member and a second lug member. The second lug member may be rotationally fixed to a joint plate fixed to the second link-housing. Torque applied to the first link-housing may be transmitted to the second link housing through the first control link and the second keyed shaft.

In some configurations, the legrest assembly includes a legrest actuator rotatably coupled at a first end to the push bar and rotatably coupled at a second end to a rear frame member of the seat bottom.

In some configurations, one end of each second control link is rotatably attached to a platform bracket that is fixed to the legrest platform. Torque may be transmitted to the platform bracket when the legrest actuator applies a force to the push bar.

In some configurations, the platform bracket moves translationally and rotationally as the legrest assembly moves relative to the seat assembly between a retracted position and an extended position.

In some configurations, the legrest actuator is coupled to the rear frame member of the seat bottom by a compliant bracket assembly. The compliant bracket assembly may allow linear movement of the second end of the legrest actuator relative to the rear frame member.

In some configurations, the compliant bracket assembly includes a tube, a bar and a spring. One end of the spring may be fixed relative to the tube and another end of the spring may be fixed relative to the bar. The bar may be reciprocatingly received in the tube. One of the tube and the bar may be attached to the rear frame member and the other of the tube and the bar may be attached to the second end of the legrest actuator.

In some configurations, the legrest actuator includes a motor, a cylinder, and a piston. The cylinder may be rotatably coupled to the push bar. The piston may be reciprocatingly received in the cylinder and rotatably coupled to the compliant bracket assembly.

The present disclosure also provides a furniture member that may include a seat assembly and a legrest assembly. The seat assembly may include armrest members, a seat bottom and a seatback. The seat bottom may be disposed between the armrest members and may be movable relative to the armrest members. The legrest assembly may include a legrest platform, a pair of articulating arm assemblies. Each of the articulating arm assemblies may include a first link-housing and a second link-housing. The first link-housings may be rotatably attached to the seat bottom. Each of the second link-housings may be rotatably attached to a respective one of the first link-housings. The second link-housings may be rotatably attached to the legrest platform. In some configurations, a distance between the legrest platform and a front frame member of the seat bottom does not change in response to movement of the seat bottom relative to the armrest members.

In some configurations, the distance between the legrest platform and the front frame member of the seat bottom does not change in response to movement of the seatback relative to the armrest members and the seat bottom.

In some configurations, the legrest assembly is mounted to the seat bottom such that the entire legrest assembly is allowed to move with the seat bottom relative to the armrest members while remaining fixed relative to the seat bottom.

In some configurations, the furniture member includes a base assembly supporting the seat assembly. The seat bottom may be movable relative to the base assembly. In some configurations, the distance between the legrest platform and the front frame member of the seat bottom does not change in response to movement of the seat bottom relative to the base assembly.

In some configurations, each of the articulating arm assemblies includes a first control link and a second control link. Each of the first control links may be disposed within a respective one of the first link-housings. Rotation of the first link-housings relative to the seat bottom may cause relative movement between the first control links and the first link-housings and relative movement between the first control links and the second link-housings.

In some configurations, each of the second control links is disposed at least partially within a respective one of the second link-housings. The second control links may be movably coupled to the second link-housings and movably coupled to the legrest platform.

In some configurations, each of the first control links are rotatably attached to a first lug member that is at least partially disposed within the respective first link-housing. The first lug member may be fixed relative to the seat bottom.

In some configurations, each of the first control links are rotatably attached to a second lug member that is at least partially disposed within the respective first link-housing. The second lug member may be fixed relative to the respective second link-housing.

In some configurations, one end of each second control link is rotatably attached to a platform bracket that is fixed to the legrest platform.

In some configurations, another end of each second control link includes a pin that is slidably received in an arcuate slot formed in the respective second link-housing.

In some configurations, the arcuate slot curves partially around a rotational axis about which the second link-housing rotates relative to the first link-housing.

In some configurations, the first link-housings are rotatably attached to brackets fixedly mounted on the front frame member of the seat bottom.

In some configurations, the legrest assembly includes a push bar fixedly attached to the first link-housings and a legrest actuator rotatably coupled at a first end to the push bar and rotatably coupled at a second end to a rear frame member of the seat bottom.

In some configurations, the legrest actuator is coupled to the rear frame member of the seat bottom by a compliant bracket assembly. The compliant bracket assembly may allow linear movement of the second end of the legrest actuator relative to the rear frame member.

In some configurations, the compliant bracket assembly includes a tube, a bar and a spring. One end of the spring may be fixed relative to the tube and another end of the spring may be fixed relative to the bar. The bar may be reciprocatingly received in the tube. One of the tube and the bar may be attached to the rear frame member and the other of the tube and the bar may be attached to the second end of the legrest actuator.

In some configurations, the legrest actuator includes a motor, a cylinder, and a piston. The cylinder may be rotatably coupled to the push bar. The piston may be reciprocatingly received in the cylinder and rotatably coupled to the compliant bracket assembly.

The present disclosure also provides a furniture member that may include a base assembly, a seat assembly, a tilt mechanism, and a recline actuator. The seat assembly may be mounted on the base assembly and may include a seat bottom, a seatback, and a seat base frame. The seat base frame may include a pair of armrest members. The seatback may be rotatably coupled to the armrest members and the seat bottom. The tilt mechanism may include a tilt actuator attached to the base assembly and a plurality of links. The tilt mechanism may move the seat bottom, the seatback and the seat base frame relative to the base assembly between an upright position and rearward tilt position. The recline actuator may be rotatably mounted to the seat base frame and the seat bottom. The recline actuator may move the seat bottom relative to the armrest members between a forward position and a rearward position. Movement of the seat bottom between the forward and rearward positions may cause movement of the seatback relative to the armrest members and the seat bottom between a reclined position and a non-reclined position. The recline actuator and the tilt actuator may be operable independently of each other.

In some configurations, the plurality of links includes a first crank link and a pair of second crank links. The first crank link may be rotatably attached to the tilt actuator and fixedly attached to a drive rod that is rotatably supported by the base assembly. The second crank links may be fixedly attached to the drive rod and movably engage respective armrest members.

In some configurations, the second crank links include rollers that rollingly engage blocks mounted on the armrest members.

In some configurations, the seat base frame includes a cross member extending between and fixedly engaging the armrest members. The base assembly may include a pair of rocker springs on which the cross member is mounted. The rocker springs may compress, deflect or flex as the tilt actuator moves the seat bottom, the seatback and the seat base frame toward the rearward tilt position.

In some configurations, the recline actuator is rotatably mounted to a bracket attached to the cross member.

In some configurations, the recline actuator is rotatably mounted to a bracket attached to a front frame member of the seat bottom.

In some configurations, the seat bottom is coupled to the armrest members by a pair of links. The links may rotate relative to the armrest members and the seat bottom in response to operation of the recline actuator to allow movement of the seat bottom relative to the armrest members.

In some configurations, the seatback includes a pair of levers having intermediate portions that are rotatably connected to slide members attached to the seat bottom. An end of each of the levers may include a protrusion that is slidably received in a curved slot formed in a respective one of the slide members.

In some configurations, the furniture member includes a legrest assembly including a legrest actuator configured to move a legrest platform between a retracted position and an extended position. The legrest actuator may be operable independently of the tilt actuator and the recline actuator.

In some configurations, the legrest actuator, the recline actuator, and the tilt actuator are all disposed underneath the seat bottom.

In some configurations, the base assembly includes a base platform, a support frame, and a height-adjustment actuator. The seat base frame may be mounted on the support frame, and the support frame may be movably mounted on the base platform. The height-adjustment actuator may be mounted to the base platform and may be configured to move the support frame vertically relative to the base platform. The height-adjustment actuator may be operable independently of the legrest actuator, the tilt actuator and the recline actuator.

In some configurations, the seatback includes a seatback frame and a seat-depth-adjustment mechanism. The seat-depth-adjustment mechanism may include a backrest support member and a seat-depth-adjustment actuator configured to move the backrest support member relative to the seatback frame. The seat-depth-adjustment actuator may be operable independently of the height-adjustment actuator, the legrest actuator, the tilt actuator and the recline actuator.

The present disclosure also provides a furniture member that may include a base assembly, a seat assembly, a tilt mechanism, a recline actuator, and a legrest assembly. The seat assembly may be mounted on the base assembly and may include a seat bottom, a seatback, and a seat base frame. The seat base frame may include a pair of armrest members. The seatback may be rotatably coupled to the armrest members and the seat bottom. The tilt mechanism may include a tilt actuator attached to the base assembly and a plurality of links. The tilt mechanism may move the seat bottom, the seatback and the seat base frame relative to the base assembly between an upright position and rearward tilt position. The recline actuator may be rotatably mounted to the seat base frame and the seat bottom. The recline actuator may move the seat bottom relative to the armrest members between a forward position and a rearward position. Movement of the seat bottom between the forward and rearward positions may cause movement of the seatback relative to the armrest members and the seat bottom between a reclined position and a non-reclined position. The recline actuator and the tilt actuator may be operable independently of each other. The legrest assembly may include a legrest platform and a legrest actuator. The legrest actuator may be mounted to the seat bottom and may be movable between first and second positions to move the legrest platform relative to the seat bottom between a retracted position and an extended position. The legrest actuator may be operable independently of the tilt actuator and the recline actuator.

In some configurations, a distance between the legrest platform and a front frame member of the seat bottom does not change in response to movement of the seat bottom relative to the armrest members between the reclined and non-reclined positions.

In some configurations, a distance between the legrest platform and the front frame member of the seat bottom does not change in response to movement of the seat bottom and the armrest members relative to the base assembly between the upright and rearward tilt positions.

In some configurations, the plurality of links includes a first crank link and a pair of second crank links. The first crank link may be rotatably attached to the tilt actuator and fixedly attached to a drive rod that is rotatably supported by the base assembly. The second crank links may be fixedly attached to the drive rod and movably engage respective armrest members.

In some configurations, the second crank links include rollers that rollingly engage blocks mounted on the armrest members.

In some configurations, the seat base frame includes a cross member extending between and fixedly engaging the armrest members. The base assembly may include a pair of rocker springs on which the cross member is mounted. The rocker springs may compress, deflect or flex as the tilt actuator moves the seat bottom, the seatback and the seat base frame toward the rearward tilt position.

In some configurations, the recline actuator is rotatably mounted to a bracket attached to the cross member.

In some configurations, the recline actuator is rotatably mounted to a bracket attached to a front frame member of the seat bottom.

In some configurations, the seat bottom is coupled to the armrest members by a pair of links. The links may rotate relative to the armrest members and the seat bottom in response to operation of the recline actuator to allow movement of the seat bottom relative to the armrest members.

In some configurations, the seatback includes a pair of levers having intermediate portions that are rotatably connected to slide members attached to the seat bottom. An end of each of the levers may include a protrusion that is slidably received in a curved slot formed in a respective one of the slide members.

In some configurations, the seatback includes a seatback frame and a seat-depth-adjustment mechanism. The seat-depth-adjustment mechanism may include a backrest support member and a seat-depth-adjustment actuator configured to move the backrest support member relative to the seatback frame. The seat-depth-adjustment actuator may be operable independently of the legrest actuator, the tilt actuator and the recline actuator.

In some configurations, the base assembly includes a base platform, a support frame, and a height-adjustment actuator. The seat base frame may be mounted on the support frame, and the support frame may be movably mounted on the base platform. The height-adjustment actuator may be mounted to the base platform and may be configured to move the support frame vertically relative to the base platform. The height-adjustment actuator may be operable independently of the seat-depth-adjustment mechanism, the legrest actuator, the tilt actuator and the recline actuator.

The present disclosure also provides a furniture member that may include a base assembly, a seat assembly, and a tilt mechanism. The seat assembly may be mounted on the base assembly and may include a seat bottom, a seatback, and a seat base frame. The seat base frame may include a pair of armrest members. The seatback may be rotatably coupled to the armrest members and the seat bottom. The tilt mechanism may include a tilt actuator attached to the base assembly and a plurality of links. The tilt mechanism may be operable to move the seat bottom, the seatback and the seat base frame relative to the base assembly between an upright position and rearward tilt position without moving the seatback relative to the seat bottom.

In some configurations, the plurality of links include a first crank link and a pair of second crank links. The first crank link may be rotatably attached to the tilt actuator and fixedly attached to a drive rod that is rotatably supported by the base assembly. The second crank links may be fixedly attached to the drive rod and movably engage respective armrest members.

In some configurations, the second crank links include rollers that rollingly engage blocks mounted on the armrest members.

In some configurations, the seat base frame includes a cross member extending between and fixedly engaging the armrest members. The base assembly may include a pair of rocker springs on which the cross member is mounted. The rocker springs may deflect as the tilt actuator moves the seat bottom, the seatback and the seat base frame toward the rearward tilt position.

In some configurations, the furniture member includes a recline actuator rotatably mounted to the seat base frame and the seat bottom. The recline actuator may move the seat bottom relative to the armrest members between a forward position and a rearward position. Movement of the seat bottom between the forward and rearward positions may cause movement of the seatback relative to the armrest members and the seat bottom between a reclined position and a non-reclined position. The recline actuator and the tilt actuator are operable independently of each other.

In some configurations, the recline actuator is rotatably mounted to a bracket attached to the cross member, and the recline actuator is rotatably mounted to a bracket attached to a front frame member of the seat bottom.

The present disclosure also provides a furniture member that may include a base assembly, a seat assembly, and a recline actuator. The seat assembly may be mounted on the base assembly and may include a seat bottom, a seatback, and a seat base frame. The seat base frame may include a pair of armrest members. The seatback may be rotatably coupled to the armrest members and the seat bottom. The recline actuator may be rotatably mounted to the seat base frame and the seat bottom. The recline actuator may move the seat bottom relative to the armrest members between a forward position and a rearward position. Movement of the seat bottom between the forward and rearward positions may cause movement of the seatback relative to the armrest members and the seat bottom between a reclined position and a non-reclined position. The seat base frame may be movable relative to the base assembly between an upright position and a rearward tilt position. The recline actuator is operable to move the seat bottom between the forward and rearward positions and move the seatback between the reclined and non-reclined positions without moving the seat base frame relative to the base assembly.

In some configurations, the seat bottom is coupled to the armrest members by a pair of links. The links may rotate relative to the armrest members and the seat bottom in response to operation of the recline actuator to allow movement of the seat bottom relative to the armrest members.

In some configurations, the seatback includes a pair of levers having intermediate portions that are rotatably connected to slide members attached to the seat bottom. An end of each of the levers includes a protrusion that is slidably received in a curved slot formed in a respective one of the slide members.

In some configurations, the seat base frame includes a cross member extending between and fixedly engaging the armrest members. The base assembly may include a pair of rocker springs on which the cross member is mounted. The rocker springs may deflect as the seat base frame moves toward the rearward tilt position.

In some configurations, the recline actuator is rotatably mounted to a bracket attached to the cross member, and the recline actuator is rotatably mounted to a bracket attached to a front frame member of the seat bottom.

The present disclosure also provides a furniture member that may include a base assembly and a seat assembly. The base assembly may include a base structure, a post, a support frame, and a height-adjustment mechanism. The post may be fixedly mounted on the base structure and may extend vertically upward therefrom. The support frame may include a cross member and a sleeve. The sleeve may slidably and rotatably receive the post for vertical movement of the support frame relative to the base structure along a longitudinal axis of the post and for rotational movement relative to the base structure about the longitudinal axis of the post. The height-adjustment mechanism may include a height-adjustment actuator configured to move the support frame vertically along the longitudinal axis. The cross member of the support frame may include a pair of rocker springs mounted thereon. The seat assembly may be mounted on the rocker springs and may include a seat bottom, a seatback, and a seat base frame. The seat base frame may include a pair of armrest members.

In some configurations, the height-adjustment mechanism includes a first link, a second link, and a slider block. The height-adjustment actuator may be attached to the base structure and the first link. The first link may be rotatable about a rotational axis that is fixed relative to the base structure. The second link may be rotatably coupled to the first link and the slider block. The slider block may slidably engage the post and may be disposed between the sleeve and the base structure.

In some configurations, the slider block includes a pair of protrusions. The sleeve may include a peg disposed angularly between the protrusions. Interference between the protrusions and the peg may define a range of rotational movement of the support frame relative to the base structure.

In some configurations, the slider block is rotationally fixed relative to the post.

In some configurations, the furniture member includes a tilt mechanism including a tilt actuator attached to the base assembly and a plurality of links. The tilt mechanism may move the seat bottom, the seatback and the seat base frame relative to the base assembly between an upright position and rearward tilt position.

In some configurations, the furniture member includes a recline actuator rotatably mounted to the seat base frame and the seat bottom. The recline actuator may move the seat bottom relative to the armrest members between a forward position and a rearward position. Movement of the seat bottom between the forward and rearward positions may cause movement of the seatback relative to the armrest members and the seat bottom between a reclined position and a non-reclined position.

In some configurations, the furniture member includes a legrest assembly having a legrest platform and a legrest actuator. The legrest actuator may be mounted to the seat bottom and movable between first and second positions to move the legrest platform relative to the seat bottom between a retracted position and an extended position.

In some configurations, the entire legrest assembly is movable with the support frame relative to the base structure along the longitudinal axis of the post.

In some configurations, the furniture member includes a tilt mechanism, a recline actuator, and legrest assembly. The tilt mechanism may include a tilt actuator attached to the base assembly and a plurality of links. The tilt mechanism may move the seat bottom, the seatback and the seat base frame relative to the base assembly between an upright position and rearward tilt position. The height-adjustment actuator and the tilt actuator may be operable independently of each other. The recline actuator may be rotatably mounted to the seat base frame and the seat bottom. The recline actuator may move the seat bottom relative to the armrest members between a forward position and a rearward position. Movement of the seat bottom between the forward and rearward positions may cause movement of the seatback relative to the armrest members and the seat bottom between a reclined position and a non-reclined position. The height-adjustment actuator, the recline actuator and the tilt actuator may be operable independently of each other. The legrest assembly may include a legrest platform and a legrest actuator. The legrest actuator may be mounted to the seat bottom and movable between first and second positions to move the legrest platform relative to the seat bottom between a retracted position and an extended position. The legrest actuator may be operable independently of the height-adjustment actuator, the tilt actuator and the recline actuator.

In some configurations, the furniture member includes a cover fixed to the base structure and cooperating with the base structure to at least partially enclose the height-adjustment actuator.

In some configurations, the rocker springs are U-shaped members.

The present disclosure also provides a furniture member that may include a base assembly and a seat assembly. The base assembly may include a base structure, a post, a support frame, and a height-adjustment mechanism. The post may be fixedly mounted on the base structure and may extend vertically upward therefrom. The support frame may include a cross member and a sleeve. The sleeve may slidably receive the post for vertical movement of the support frame relative to the base structure along a longitudinal axis of the post. The cross member may include an aperture through which the post extends. The height-adjustment mechanism may include a height-adjustment actuator mounted to the base structure and configured to move the sleeve and the support frame vertically along the longitudinal axis. The seat assembly may be mounted on the cross member and may be movable with the cross member relative to the base structure vertically along the longitudinal axis of the post. The seat assembly may include a seat bottom, a seatback, and a seat base frame. The seat base frame may include a pair of armrest members.

In some configurations, the height-adjustment mechanism includes a first link, a second link, and a slider block. The height-adjustment actuator may be attached to the first link. The first link may be rotatable about a rotational axis that is fixed relative to the base structure. The second link may be rotatably coupled to the first link and the slider block. The slider block may slidably engage the post and may be disposed between the sleeve and the base structure.

In some configurations, the slider block includes a pair of protrusions. The sleeve may include a peg disposed angularly between the protrusions. Interference between the protrusions and the peg may define a range of rotational movement of the support frame relative to the base structure.

In some configurations, the slider block is rotationally fixed relative to the post.

In some configurations, the furniture member includes a legrest assembly having a legrest platform and a legrest actuator. The legrest actuator may be mounted to the seat bottom and movable between first and second positions to move the legrest platform relative to the seat bottom between a retracted position and an extended position.

In some configurations, the entire legrest assembly is movable with the support frame relative to the base structure along the longitudinal axis of the post.

In some configurations, the furniture member includes a tilt mechanism including a tilt actuator attached to the base assembly and a plurality of links, the tilt mechanism moving the seat bottom, the seatback and the seat base frame relative to the base assembly between an upright position and rearward tilt position.

In some configurations, the furniture member includes a recline actuator rotatably mounted to the seat base frame and the seat bottom. The recline actuator may move the seat bottom relative to the armrest members between a forward position and a rearward position. Movement of the seat bottom between the forward and rearward positions may cause movement of the seatback relative to the armrest members and the seat bottom between a reclined position and a non-reclined position.

In some configurations, the furniture member includes a cover fixed to the base structure and cooperating with the base structure to at least partially enclose the height-adjustment actuator.

In some configurations, the cross member of the support frame includes a pair of rocker springs mounted thereon. The seat assembly may be mounted on the rocker springs.

In some configurations, the rocker springs are U-shaped members.

The present disclosure also provides a furniture member that may include a seat base frame, a seat bottom, and a seatback. The seat bottom may be attached to the seat base frame. The seatback may be attached to the seat base frame and may include a seatback frame and a seat-depth-adjustment mechanism. The seat-depth-adjustment mechanism may include a backrest support member and a seat-depth-adjustment actuator. The seat-depth-adjustment actuator may be mounted to the seatback frame and may be drivingly coupled to the backrest support member to move the backrest support member relative to the seatback frame and the seat bottom between a retracted position and an extended position.

In some configurations, the backrest support member is closer to a front frame member of the seat bottom when the backrest support member is in the extended position than when the backrest support member is in the retracted position.

In some configurations, an upper edge of the backrest support members is a first distance from an upper edge of the seatback frame when the backrest support member is in the retracted position. The upper edge of the backrest support members may be a second distance from the upper edge of the seatback frame when the backrest support member is in the extended position. The second distance may be less than the first distance.

In some configurations, the furniture member includes a recline actuator coupled to the seat bottom. The recline actuator may move the seat bottom relative to the seat base frame and may move the seatback frame relative to the seat bottom and the seat base frame. The seat-depth-adjustment actuator and the recline actuator may be operable independently of each other.

In some configurations, the furniture member includes upholstery that at least partially surrounds the seatback. The upholstery may stretch and/or unfold when the backrest support member moves from the retracted position to the extended position.

In some configurations, the upholstery includes a first portion formed from a first material and a second portion formed from a second material. The second material has a higher elasticity than the first material.

In some configurations, the elasticity of the second portion of the upholstery biases the backrest support member toward the retracted position.

In some configurations, the seat-depth-adjustment mechanism includes first and second backrest support members that move together between the retracted and extended positions.

In some configurations, linkages movably connect the first and second backrest support members to each other and to the seat-depth-adjustment actuator.

In some configurations, the linkages include a pair of drive linkages. Each of the drive linkages may include a first drive link, a second drive link, and a first connector link. First ends of the first and second drive links may be rotatably coupled to the seatback frame. Second ends of the first and second drive links may movably engage the backrest support members. The first connector link of each drive linkage may be rotatably connected to the respective first and second drive links.

In some configurations, the linkages further comprise a pair of guide linkages. Each of the guide linkages may include a first guide link, a second guide link, and a second connector link. First ends of the first guide links may be rotatably coupled to the seatback frame. Second ends of the first guide links may be rotatably coupled to a respective one of the first and second backrest support members. First ends of the second guide links may be rotatably coupled to the seatback frame. Second ends of the second guide links may be rotatably coupled to a respective one of the first and second backrest support members. The second connector link of each guide linkage may be rotatably connected to the respective first and second guide links.

In some configurations, the second ends of the first and second drive links include rollers that rollingly engage the backrest support members.

The present disclosure also provides a furniture member that may include a seat base frame, a seat bottom, and a seatback. The seat base frame may include an armrest member. The seat bottom may be attached to the seat base frame. The seatback may be attached to the seat base frame and may include a seatback frame and a seat-depth-adjustment mechanism. The seatback frame may be rotatably coupled to the armrest member and rotatably coupled to the seat bottom for movement between a reclined position and a non-reclined position. The seat-depth-adjustment mechanism may include a backrest support member and a seat-depth-adjustment actuator. The seat-depth-adjustment actuator may be mounted to the seatback frame and drivingly coupled to the backrest support member to move the backrest support member relative to the seatback frame, the seat bottom and the armrest member between a retracted position and an extended position. A position of the backrest support member does not change in response to rotation of the seatback frame relative to the armrest member and the seat bottom between the reclined and non-reclined position. The backrest support member may be closer to a front frame member of the seat bottom when the backrest support member is in the extended position than when the backrest support member is in the retracted position.

In some configurations, an upper edge of the backrest support members is a first distance from an upper edge of the seatback frame when the backrest support member is in the retracted position. The upper edge of the backrest support members may be a second distance from the upper edge of the seatback frame when the backrest support member is in the extended position. The second distance is less than the first distance.

In some configurations, the furniture member includes a recline actuator coupled to the seat bottom. The recline actuator may move the seatback frame relative to the seat bottom and the seat base frame between the reclined and non-reclined positions. The seat-depth-adjustment actuator and the recline actuator may be operable independently of each other.

In some configurations, the furniture member includes upholstery that at least partially surrounds the seatback. The upholstery stretches and/or unfolds when the backrest support member moves from the retracted position to the extended position.

In some configurations, the upholstery includes a first portion formed from a first material and a second portion formed from a second material. The second material has a higher elasticity than the first material.

In some configurations, elasticity of the second portion of the upholstery biases the backrest support member toward the retracted position.

In some configurations, the seat-depth-adjustment mechanism includes first and second backrest support members that move together between the retracted and extended positions.

In some configurations, linkages movably connect the first and second backrest support members to each other and to the seat-depth-adjustment actuator.

In some configurations, the linkages include a pair of drive linkages. Each of the drive linkages may include a first drive link, a second drive link, and a first connector link. First ends of the first and second drive links may be rotatably coupled to the seatback frame. Second ends of the first and second drive links may movably engage the backrest support members. The first connector link of each drive linkage may be rotatably connected to the respective first and second drive links.

In some configurations, the linkages also include a pair of guide linkages. Each of the guide linkages may include a first guide link, a second guide link, and a second connector link. First ends of the first guide links may be rotatably coupled to the seatback frame. Second ends of the first guide links may be rotatably coupled to a respective one of the first and second backrest support members. First ends of the second guide links may be rotatably coupled to the seatback frame. Second ends of the second guide links may be rotatably coupled to a respective one of the first and second backrest support members. The second connector link of each guide linkage may be rotatably connected to the respective first and second guide links.

In some configurations, he second ends of the first and second drive links include rollers that rollingly engage the backrest support members.

In some configurations, the backrest support member translates and rotates relative to the seatback frame when the backrest support member moves between the retracted position and the extended position.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
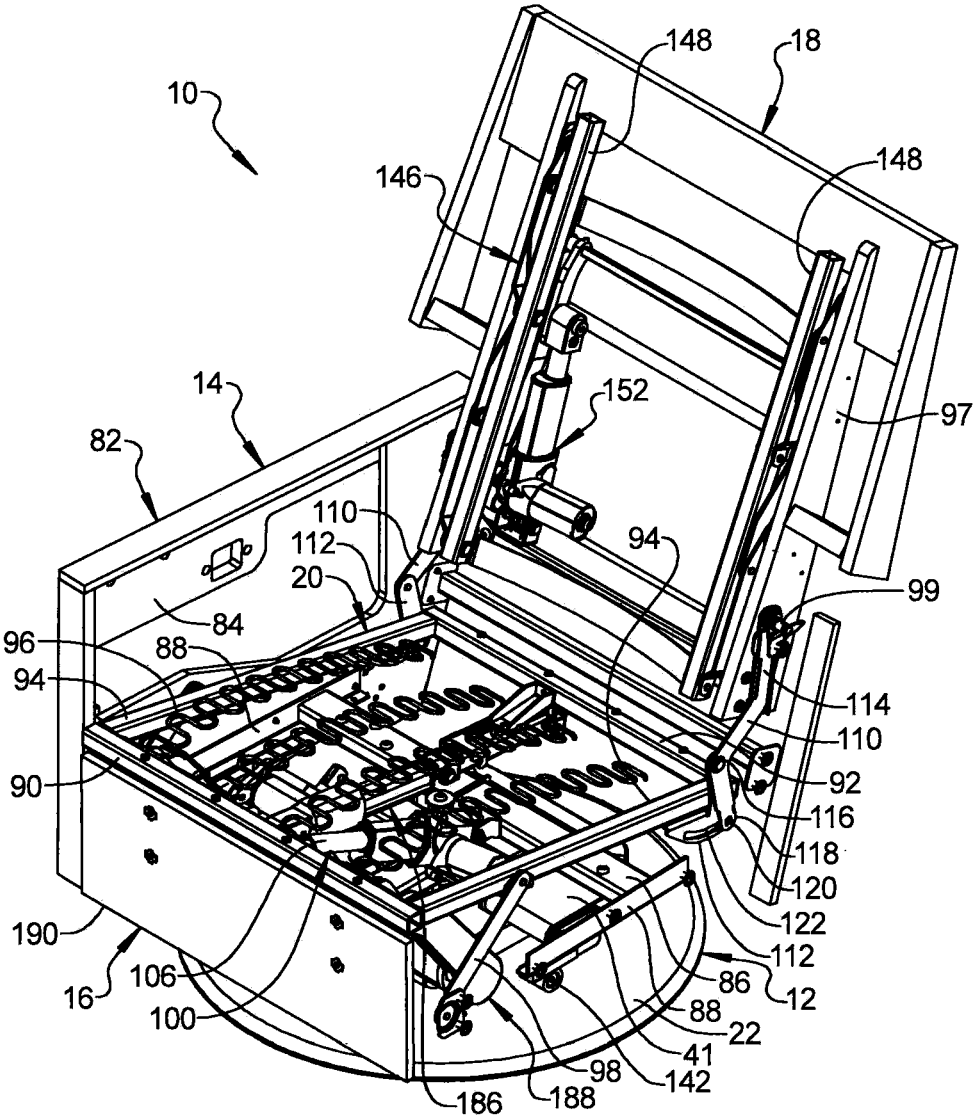
FIG. 1 is a perspective view of a furniture member (with an armrest member removed for illustration purposes) with a seat assembly in an upright and non-reclined position and with a legrest assembly in a retracted position.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 5:
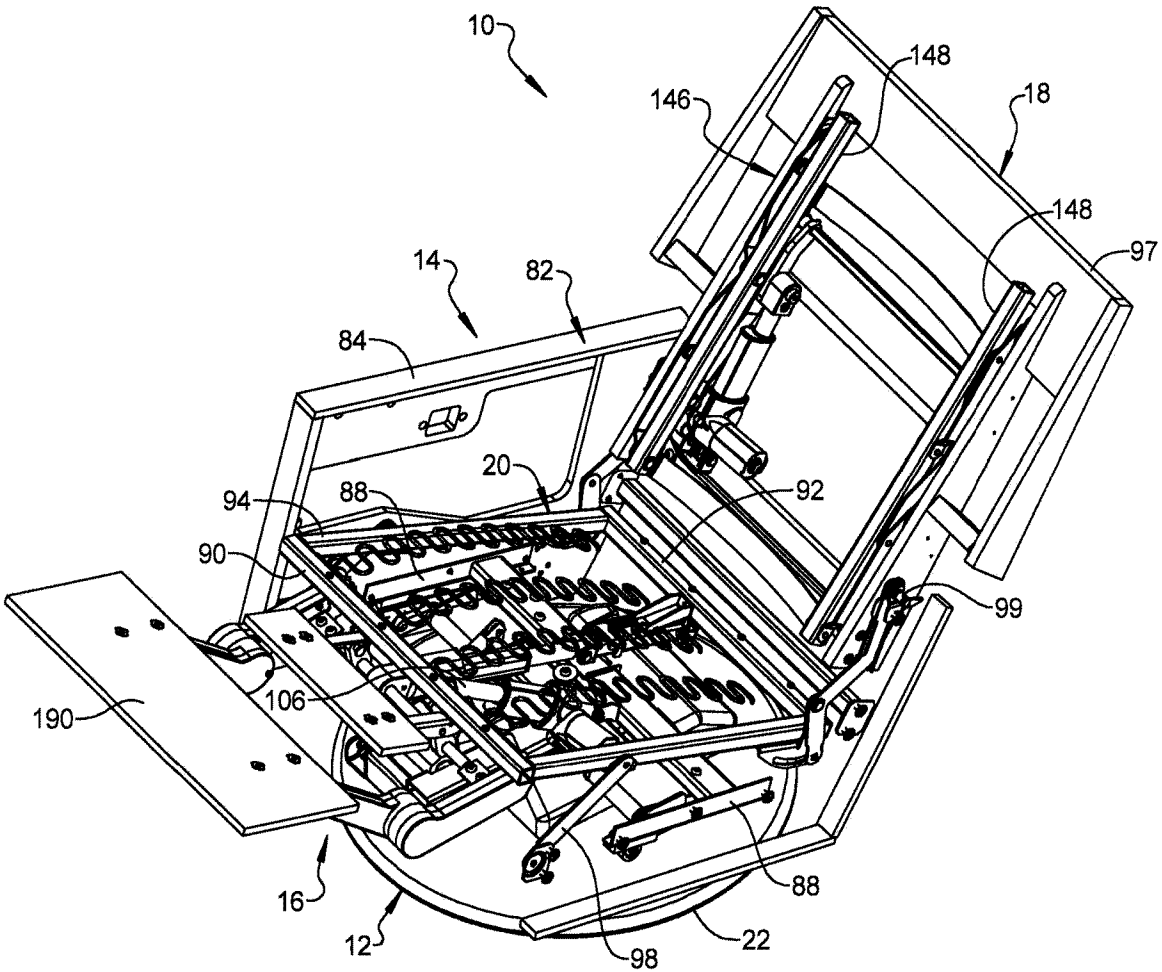
FIG. 5 is a perspective view of the furniture member (with one of the armrest members removed for illustration purposes) with the seat assembly in a rearward tilted and non-reclined position and with the legrest assembly in the extended position.
Figure 6:
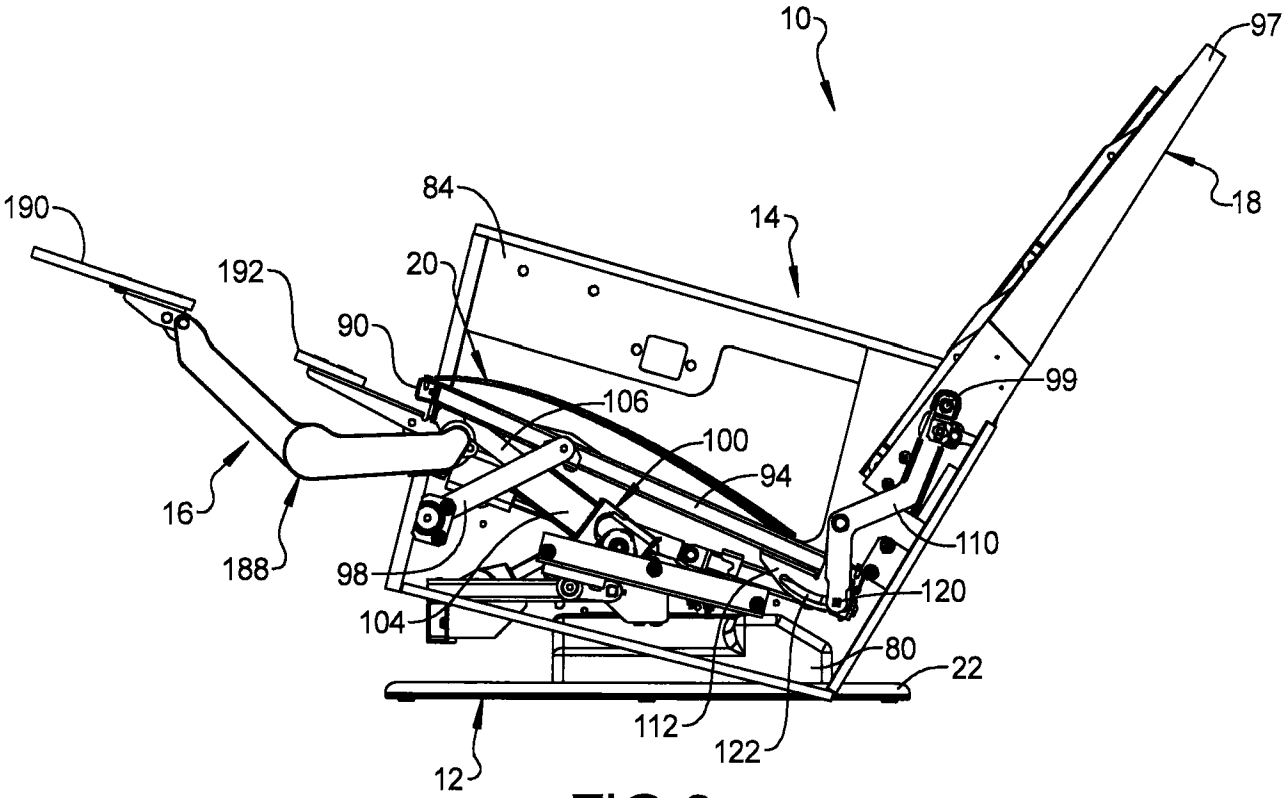
FIG. 6 is a side view of the furniture member (with one of the armrest members removed for illustration purposes) in the positions of FIG. 5.
Figure 7:
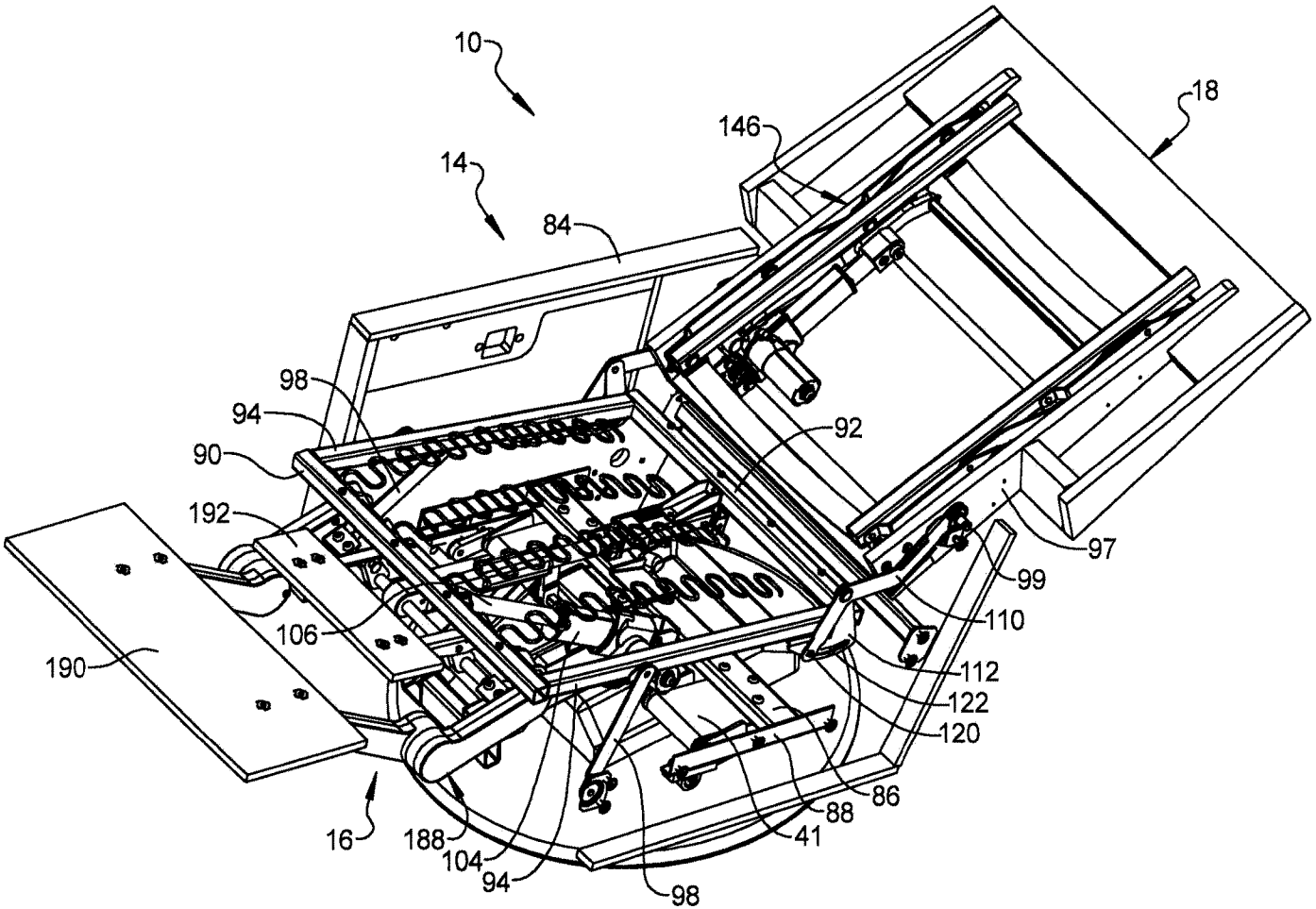
FIG. 7 is a perspective view of the furniture member (with one of the armrest members removed for illustration purposes) with the seat assembly in a rearward tilted and reclined position and with the legrest assembly in the extended position.
Figure 8:
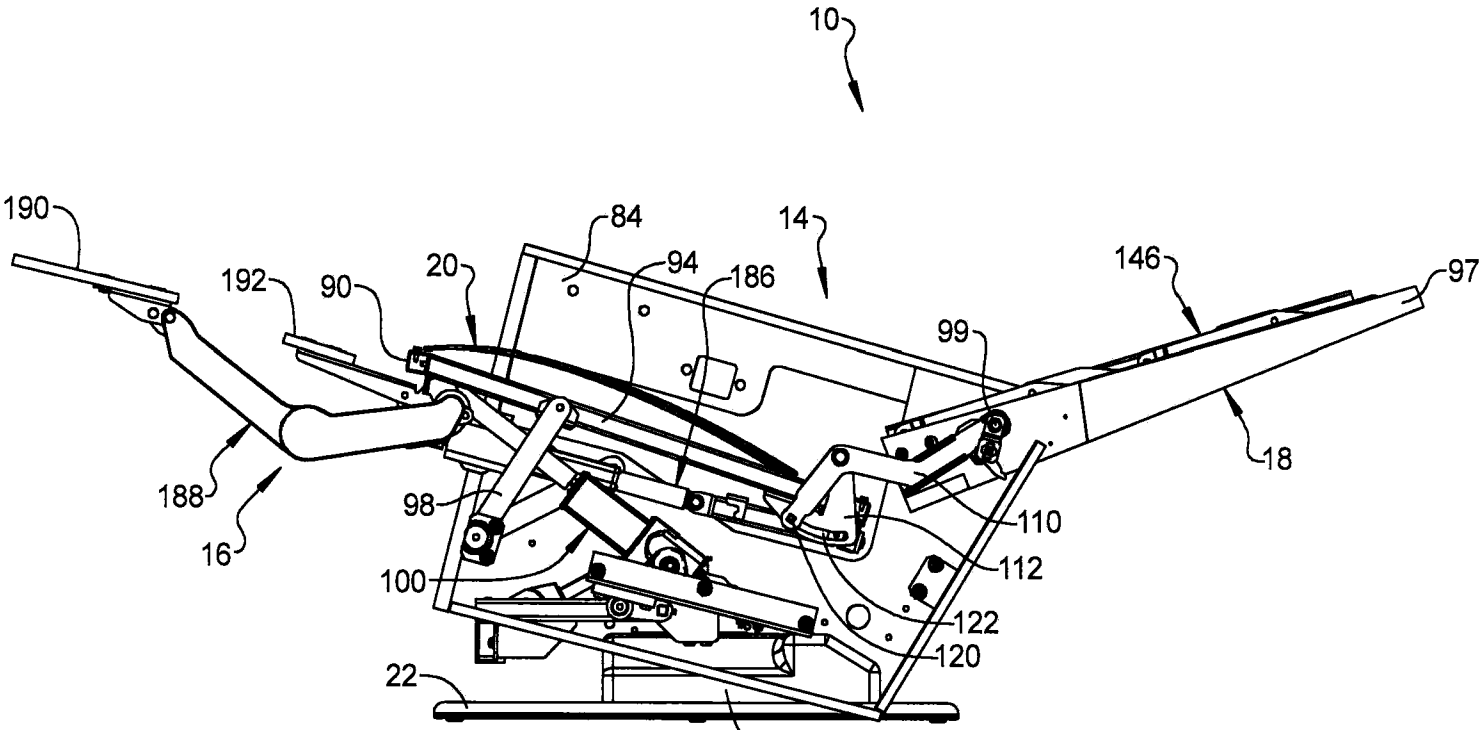
FIG. 8 is a side view of the furniture member (with one of the armrest members removed for illustration purposes) in the positions of FIG. 7.

With reference to FIGS. 1-12, a furniture member 10 is provided that may include a base assembly 12, a seat assembly 14, and a legrest assembly 16. As will be described in more detail below, the legrest assembly 16 is movable relative to the seat assembly 14 between a retracted position (FIG. 1) and an extended position (FIGS. 3-8). The seat assembly 14 can: swivel on the base assembly 12 (see FIG. 12); rock forward and backward relative to the base assembly 12 (see FIGS. 16 and 17); move vertically relative to the base assembly 12 between a lowered position (FIG. 2) and a raised position (FIG. 69) (e.g., to adjust a height of the seat assembly 14); and move (i.e., tilt) relative to the base assembly 12 between an upright position (FIGS. 1 and 2) and a rearward tilted position (FIGS. 5-8). A seatback 18 of the seat assembly 14 can move (i.e., recline) relative to the base assembly 12 and a seat bottom 20 of the seat assembly 14 between a non-reclined position (FIGS. 1-6) and a reclined position (FIGS. 7 and 8). Furthermore, a seat depth can be adjusted by moving a portion of the seatback 18 forward (FIGS. 10 and 11) and backward (FIGS. 1 and 2) relative to the seat bottom 20 and the base assembly 12. The swiveling, tilting, reclining, legrest extension, height adjustment, and seat depth adjustment are all done independently of each other. In this manner, any one of those movements can be made without making any of the other movements, and any one of the movements can be made while making any one or more of the other movements.

Referring now to FIGS. 13-20, the base assembly 12 may include a base platform (or base structure) 22, a post 24, a support frame 26, and a height-adjustment mechanism 28. The base platform 22 may be a plate that supports the furniture member 10 on a ground surface upon which the furniture member 10 may be disposed while an occupant is seated in the furniture member 10. While the base platform 22 is shown in the figures having a circular shape, the base platform 22 could have any other suitable shape (e.g., rectangular, oval, polygonal, etc.). In other configurations, the base platform 22 could include a plurality of legs or spokes, rather than a single, continuous plate. In some configurations, the base platform 22 could include cutouts or weight-reducing pockets.

The post 24 may be a generally cylindrical member that is fixed to the base platform 22 and extends vertically upward from an upward-facing surface 29 of the base platform 22 (e.g., a surface facing opposite the ground surface). A lower end of the post 24 may include a lower flange or stop collar 30 (FIGS. 13 and 15) that engages the base platform 22. An upper end of the post 24 may include an upper flange or stop collar 32. The lower and upper stop collars 30, 32 may define a range of motion for the height adjustment of the seat assembly 14 relative the base assembly 12.

Figure 17:
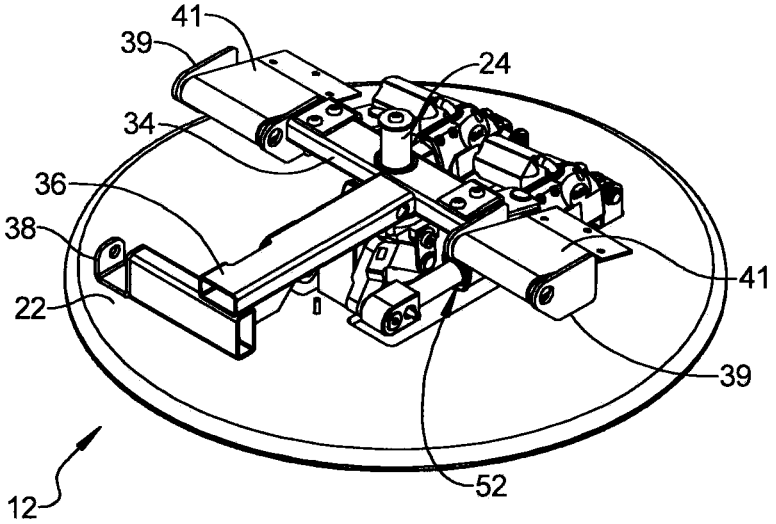
FIG. 17 is a perspective view of the base assembly with rocking springs in a rocked-back position.
Figure 18:
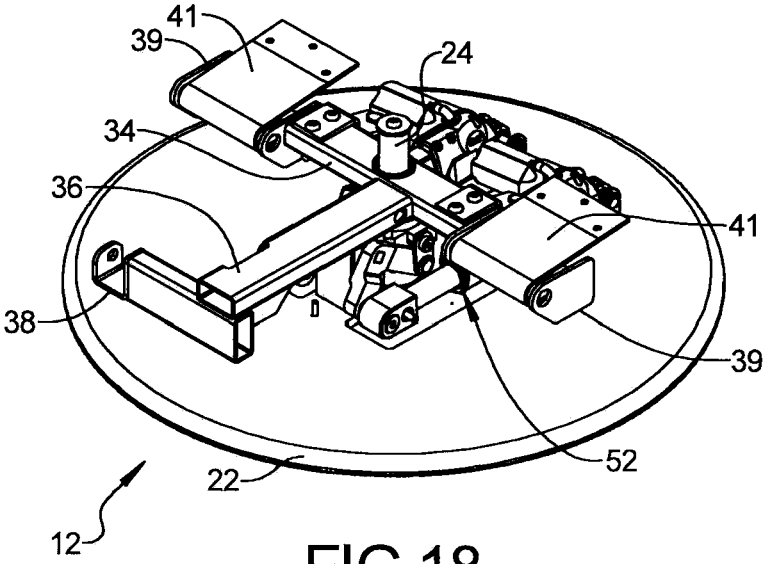
FIG. 18 is a perspective view of the base assembly with rocking springs in a rocked-forward position.
Figure 19:
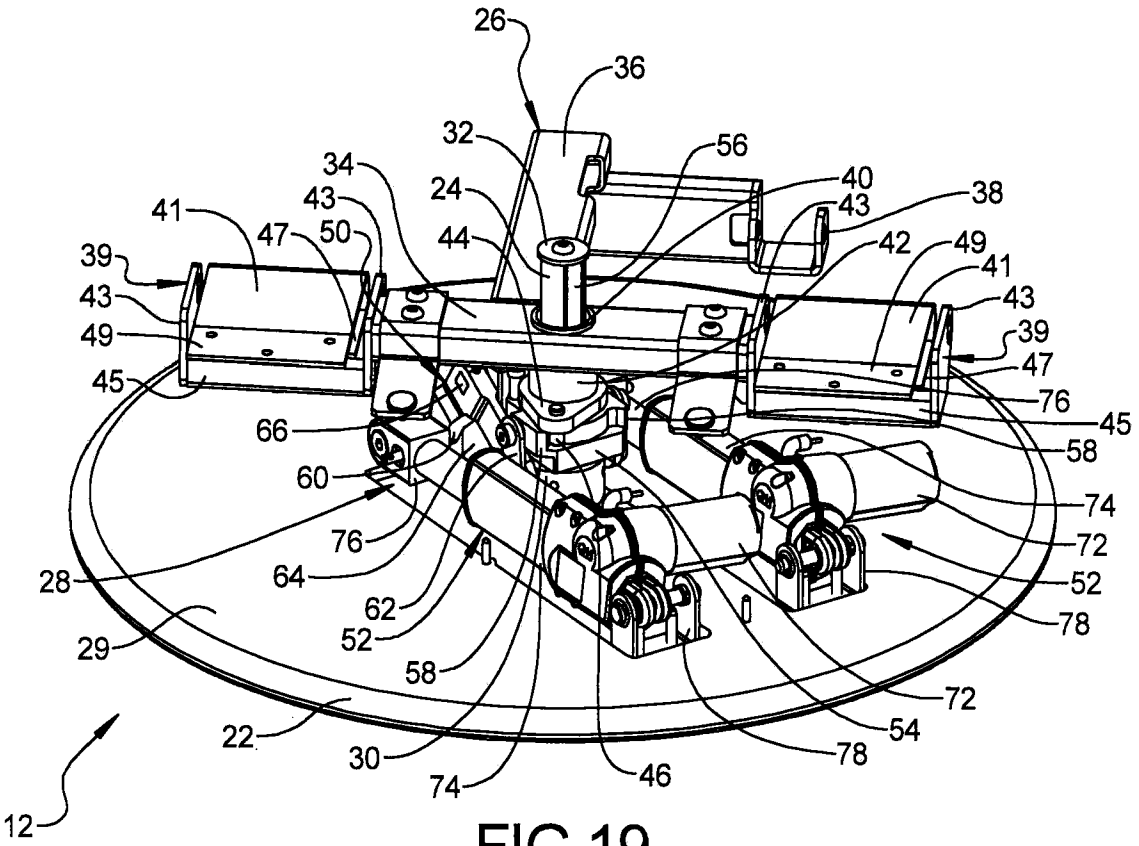
FIG. 19 is a perspective view of the base assembly in a swiveled position.

The support frame 26 may include a cross member 34, a brace member 36, and an actuator bracket 38. End portions of the cross member 34 may include brackets 39 to which rocking springs 41 are mounted. As shown in FIG. 19, each bracket 39 may include a pair of plates 43 and a beam 45 (e.g., a hollow rectangular cross section) extending between and fixedly attached (e.g., by welding and/or fasteners) to the plates 43. The rocking springs 41 may be resiliently flexible U-shaped members that support the seat assembly 14. Each rocking spring 41 may include a first leg 47 and a second leg 49. The first leg 47 may be fixedly attached (e.g., by welding and/or fasteners) to the beam 45 of the respective bracket 39. The second legs 49 may support the seat assembly 14. As shown in FIGS. 17 and 18, the second legs 49 of the rocking springs 41 can flex to allow the seat assembly 14 to rock backward and forward relative to the base platform 22. It will be appreciated that, in some configurations, the rocker springs 41 could be other types of springs (e.g., coil springs or leaf springs with different shapes than the springs 41 shown in the figures).

A bearing member 40 may extend through and fixedly engage a central portion (between the rocking springs 41) of the cross member 34. The bearing member 40 may rotatably and slidably receive the post 24. In this manner, a longitudinal axis A of the post 24 defines an axis of rotation about which the support frame 26 and the seat assembly 14 can swivel relative to the base platform 22. A tubular sleeve 42 may be fixed to the cross member 34 and the bearing member 40 and may slidably and rotatably receives the post 24. The sleeve 42 may be disposed between the cross member 34 and the lower stop collar 30 and may include a radially extending lobe 44 (i.e., the lobe 44 extends from the sleeve 42 in a radial direction that is perpendicular to the longitudinal axis A). The lobe 44 may include a pin or peg 46 extending therefrom in a direction parallel to the longitudinal axis A.

Figure 20:
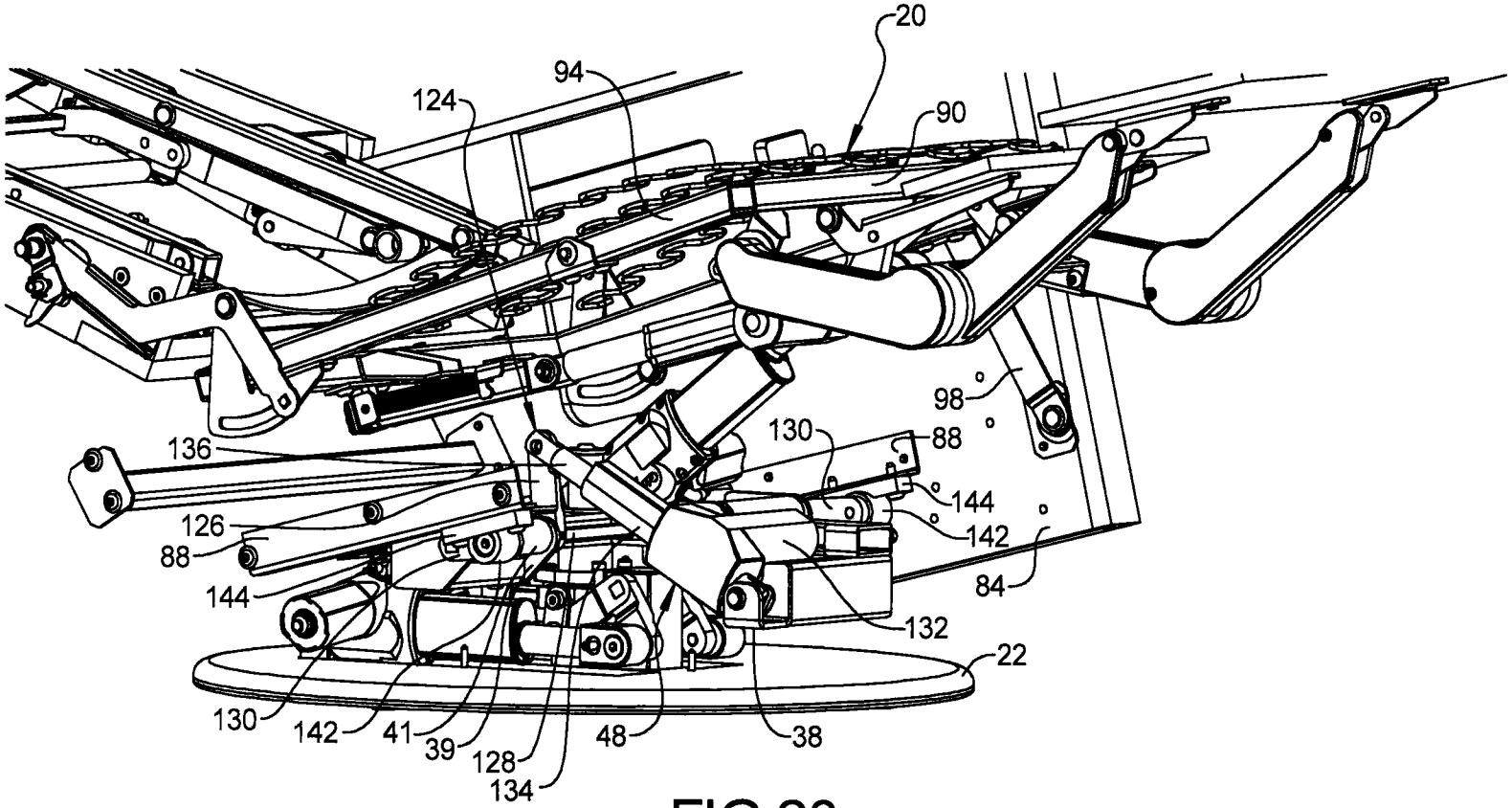
FIG. 20 is a partial perspective view of the furniture member (with one of the armrest members removed for illustration purposes) in the rearward tilted and reclined position and with the legrest assembly in the extended position.

The brace member 36 of the support frame 26 may be cantilevered off of the cross member 34 (i.e., the brace member 36 is supported at one end by the cross member and is unsupported at the other end). The actuator bracket 38 may be cantilevered off of the unsupported end of the brace member 36. As shown in FIG. 20, a tilt actuator 48 (an actuator for moving the seat assembly 14 between the upright and rearward tilted positions) is pivotably mounted to the actuator bracket 38.

The height-adjustment mechanism 28 may include a pair of linkages 50, a pair of height-adjustment actuators 52, and a slider block 54 (in some configurations, the height-adjustment mechanism 28 may include only one linkage 50 and/or only one actuator 52). The slider block 54 may slidably and non-rotatably engage the post 24. That is, the slider block 54 is slidable in an axial direction along the longitudinal axis A, but is rotationally fixed relative to the post 24. A flat surface 56 (FIG. 19) on the post 24 engages a flat surface on the slider block 54 to prevent relative rotation while allowing relative axial movement. The slider block 54 may include a pair of protrusions 58 that define a range of rotational motion of the support frame 26 and seat assembly 14 relative to the base platform 22. That is, the peg 46 on the sleeve 42 attached to the cross member 34 moves between the protrusions 58 as the support frame 26 and seat assembly 14 swivel (i.e., rotate about the longitudinal axis A). Interference between the protrusions 58 and the peg 46 limits the range of swiveling motion (as shown in FIG. 19).

Figure 9:
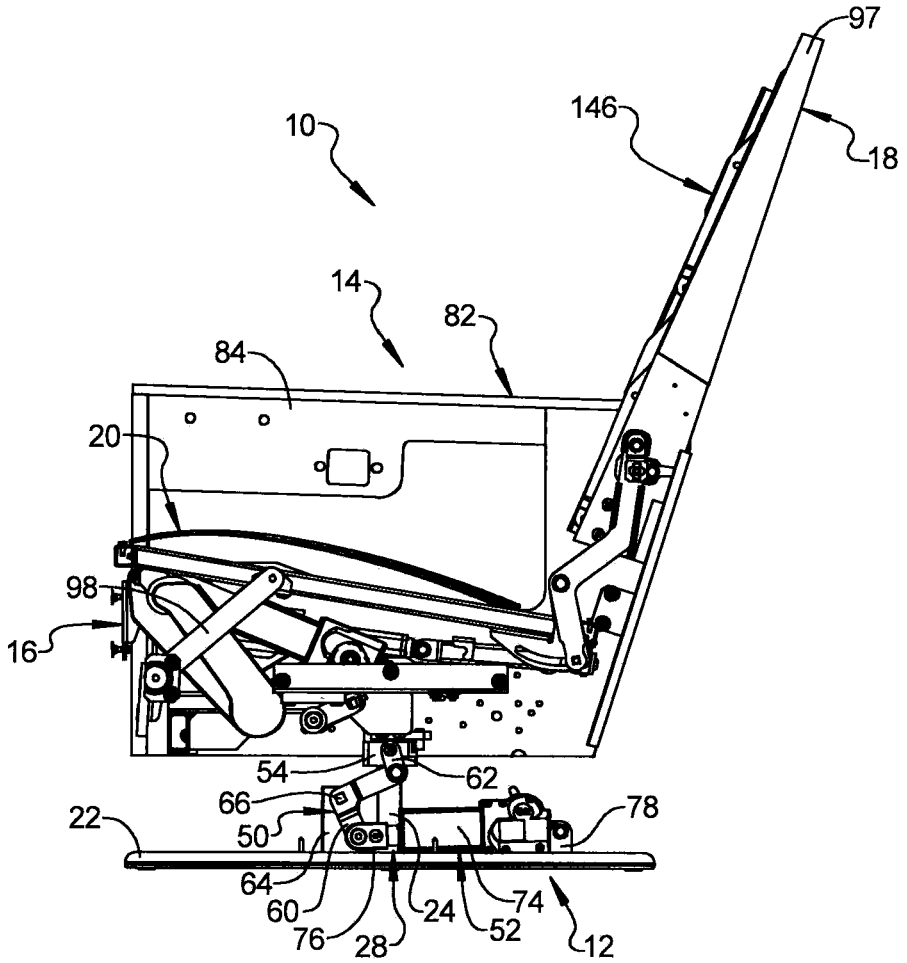
FIG. 9 is a side view of the furniture member (with one of the armrest members removed for illustration purposes) with the seat assembly in a raised position.
Figure 10:
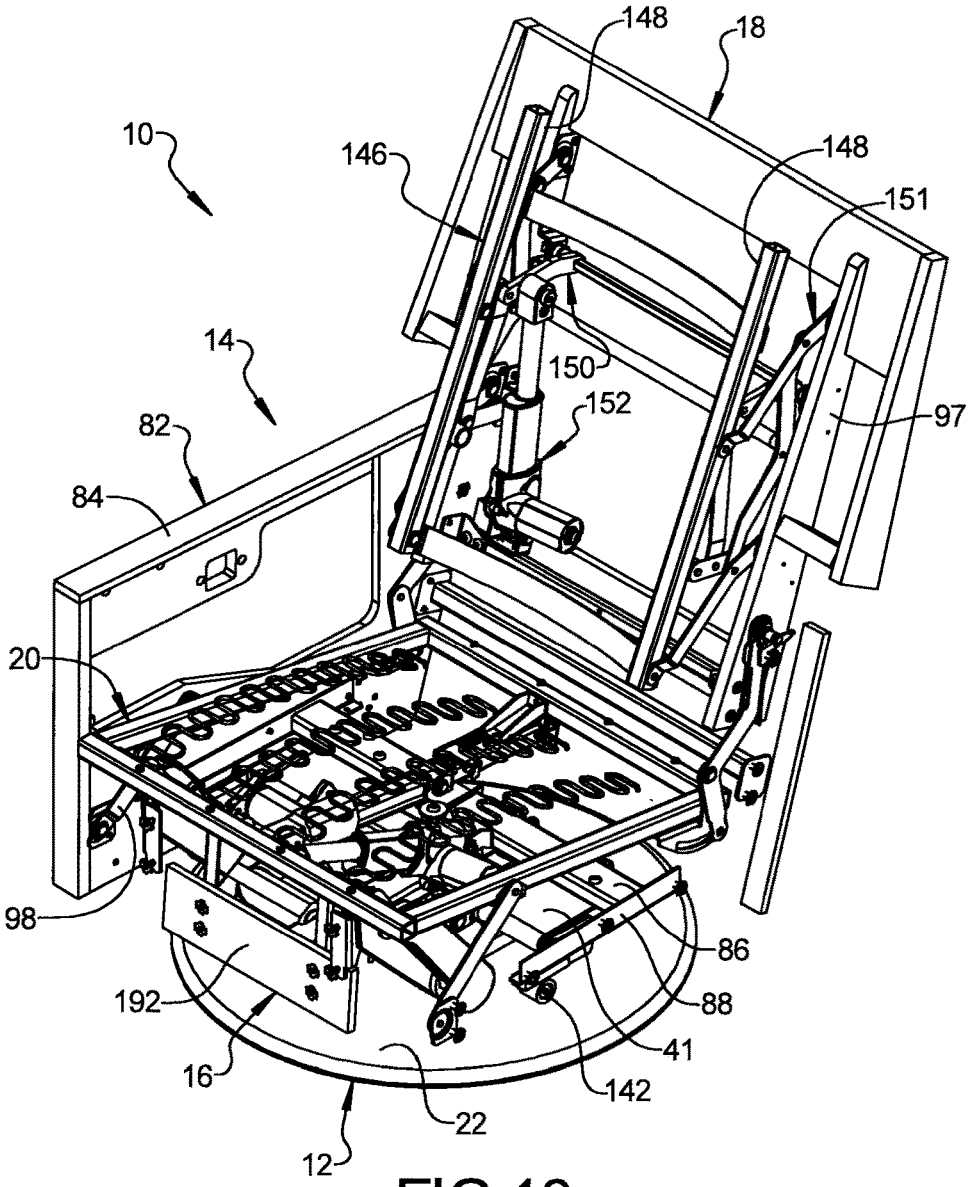
FIG. 10 is a perspective view of the furniture member (with one of the armrest members removed for illustration purposes) with a seat-depth-adjustment mechanism in a forward-extended position.
Figure 14:
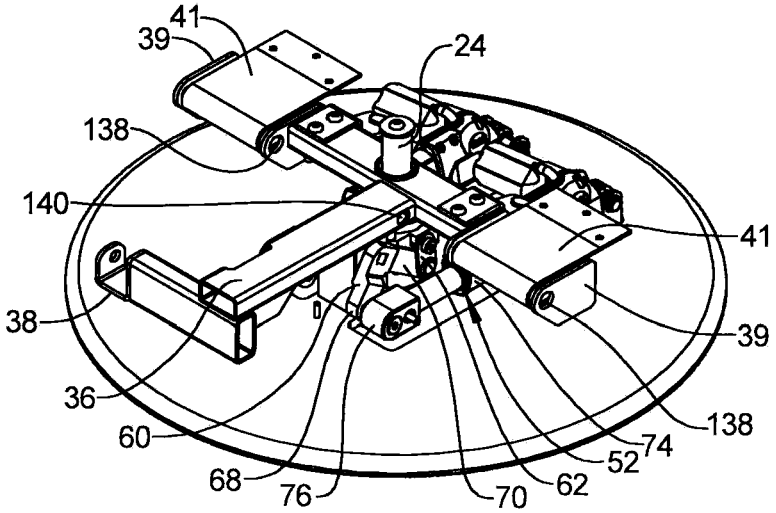
FIG. 14 is another perspective view of the base assembly in the lowered position.
Figure 15:
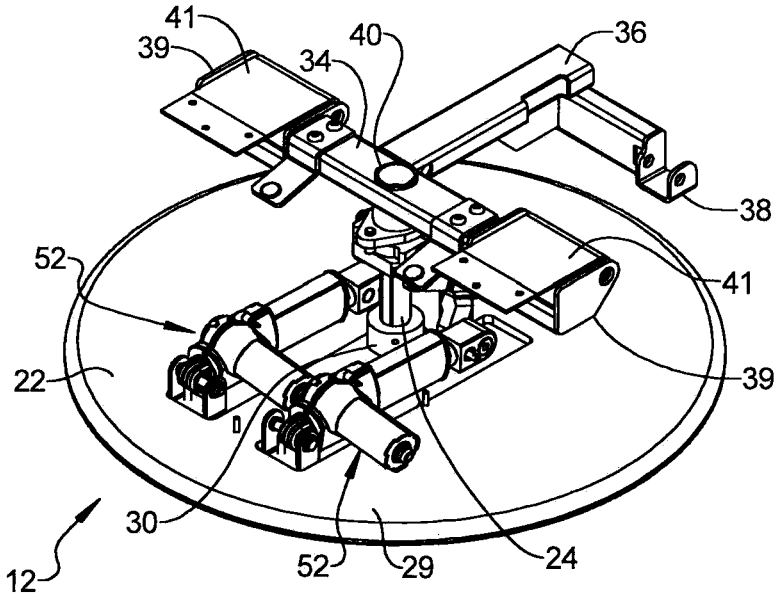
FIG. 15 is a perspective view of the base assembly in a raised position.

As shown in FIGS. 9 and 19, each linkage 50 of the height-adjustment mechanism 28 may include a first link 60 and a second link 62. The first links 60 may be L-shaped members that are both rotatably coupled to a support member (e.g., a block) 64 by a rod 66. The support member 64 is fixed to the base platform 22 and includes an aperture through which the rod 66 extends. The rod 66 includes a cylindrical portion that is rotatably received within the aperture in the support member 64 and may include end portions that are keyed to (i.e., rotationally fixed to) the first links 60. In the example shown in the figures, the end portions of the rod 66 have square profiles and are received in square apertures formed in elbow portions of the first links 60. As shown in FIG. 14, each first link 60 has a first end 68 that is rotatably coupled to a respective one of the height-adjustment actuators 52 and a second end 70 that is rotatably coupled to an end of a respective one of the second links 62. The opposite ends of the second links 62 are rotatably coupled to the slider block 54, as shown in FIG. 19.

The height-adjustment actuator 52 can be linear actuators, for example. As shown in FIG. 19, each height-adjustment actuator 52 may include a motor 72, a cylinder 74, and a piston 76. In some configurations, a protective cover 80 (FIGS. 4, 6, and 8) can be placed over the height-adjustment mechanism 28. The cover 80 may be a hollow shell that protects the height-adjustment mechanism 28 from dust, dirt, and debris. The cylinders 74 are pivotably coupled to brackets 78 mounted on the base platform 22. The pistons 76 are received in respective cylinders 74 and can move linearly relative to the cylinders 74 between extended and retracted positions (see FIGS. 14 and 16). Each piston 76 is rotatably coupled to an end of a respective first link 60. The motors 72 can be any suitable type of electromechanical motor, for example, and are operable to drive the pistons 76 relative to the cylinders 74.

Figure 16:
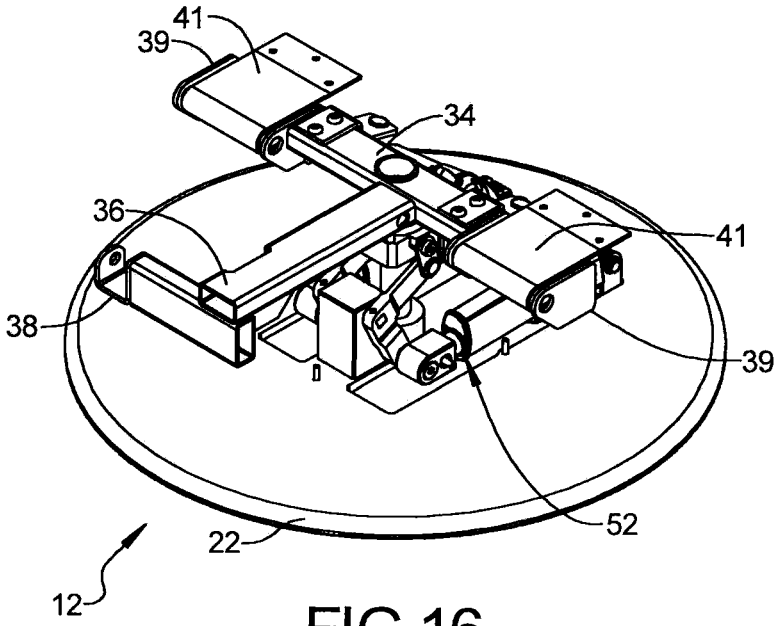
FIG. 16 is another perspective view of the base assembly in the raised position.

As shown in FIGS. 9 and 16, operation of the motors 72 in one direction causes the pistons 76 to move relative to the cylinders 74 toward a retracted position, which causes the linkages 50 to move the slider block 54 upward along the post 24. The upward movement of the slider block 54 pushes the bearing member 40 and support frame 26 upward along the post 24 to move the seat assembly 14 vertically upward relative to the base platform 22 to the raised position (FIG. 9). Likewise, operation of the motors in the opposite direction causes the pistons 76 to move relative to the cylinders 74 toward an extended position, which causes the linkages 50 to move the slider block 54 downward along the post 24, as shown in FIG. 14. The downward movement of the slider block 54 allows the bearing member 40 and support frame 26 to move downward along the post 24 to move the seat assembly 14 vertically downward relative to the base platform 22 to the lowered position (FIG. 1).

As shown in FIGS. 1-12, the seat assembly 14 may include a seat base frame 82, the seatback 18, and the seat bottom 20. The seat base frame 82 may include a pair of armrest member 84 (only one of which is shown in the figures) and a cross member 86. The seatback 18 may include a seatback frame 97 that is rotatably coupled to the armrest members 84 by a pair of pins 99. The cross member 86 extends between and fixedly engages the armrest members 84 or angle brackets 88 fixedly mounted to the armrest members 84. The cross member 86 may support the weight of the seat assembly 14 and may be fixedly attached (e.g., by welding and/or fasteners) to the second legs 49 of the rocking springs 41 to allow the seat assembly 14 to rock forward and backward relative to the base platform 22.

Figure 2:
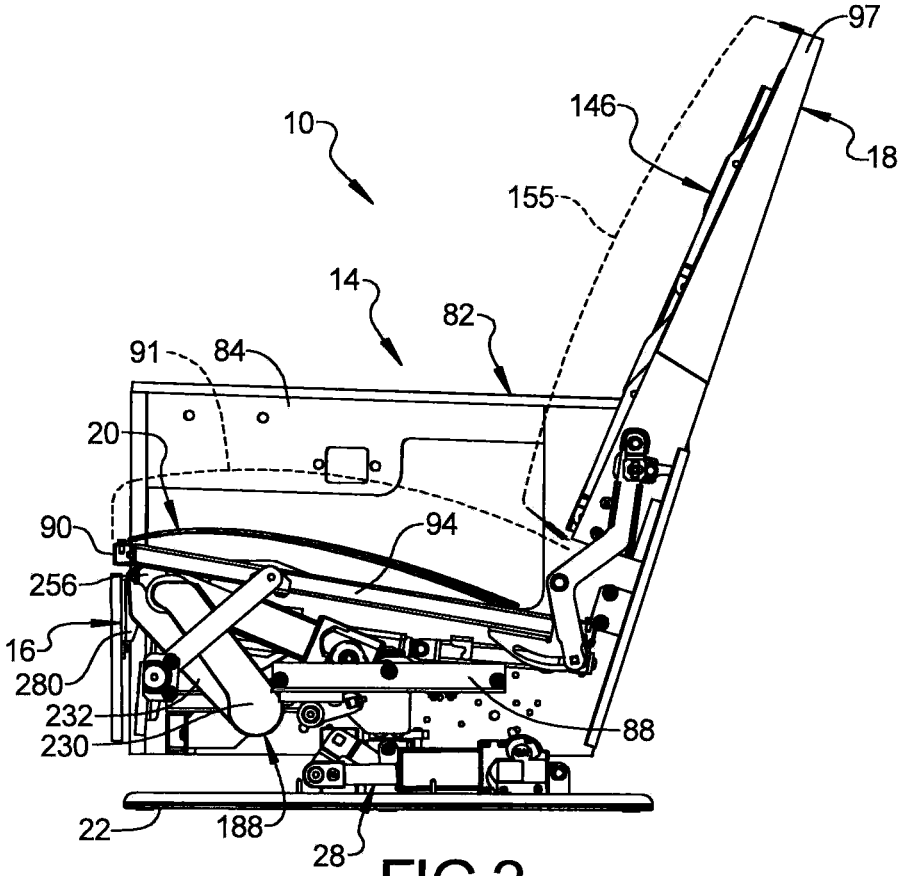
FIG. 2 is a side view of the furniture member (with one of the armrest members removed for illustration purposes and with cushions and upholstery shown schematically) in the positions of FIG. 1.
Figure 11:
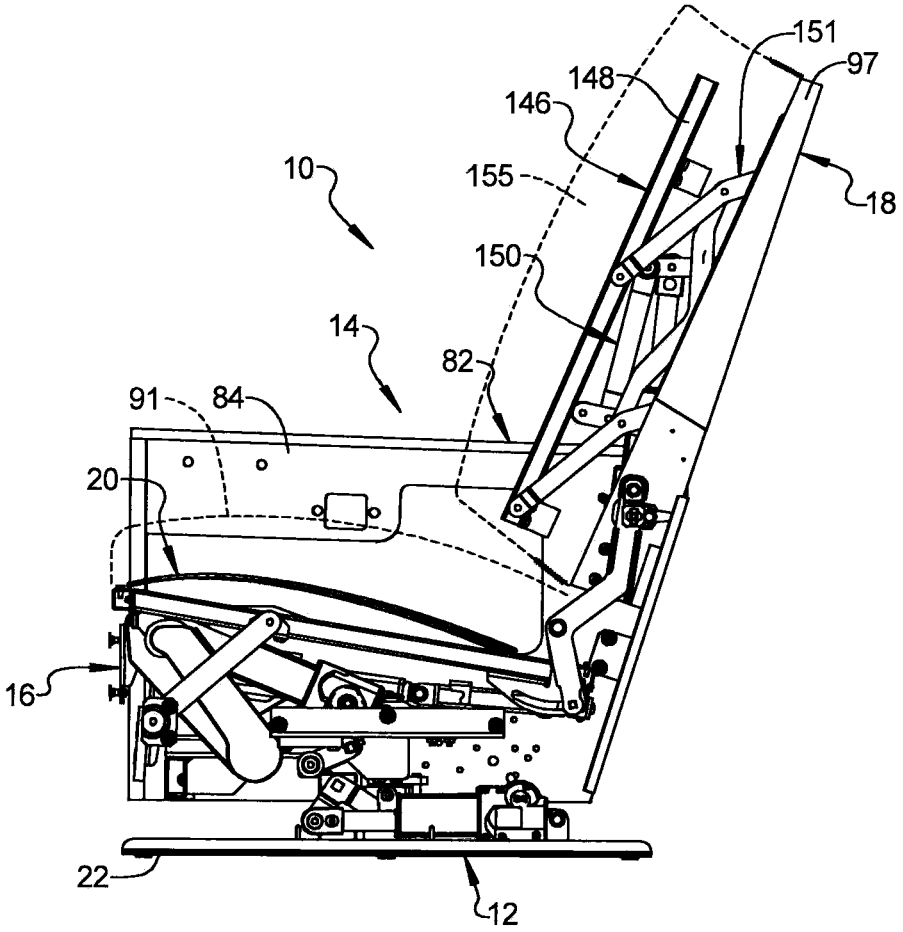
FIG. 11 is a side view of the furniture member (with one of the armrest members removed for illustration purposes and with cushions and upholstery shown schematically) in the positions of FIG. 10.
Figure 12:
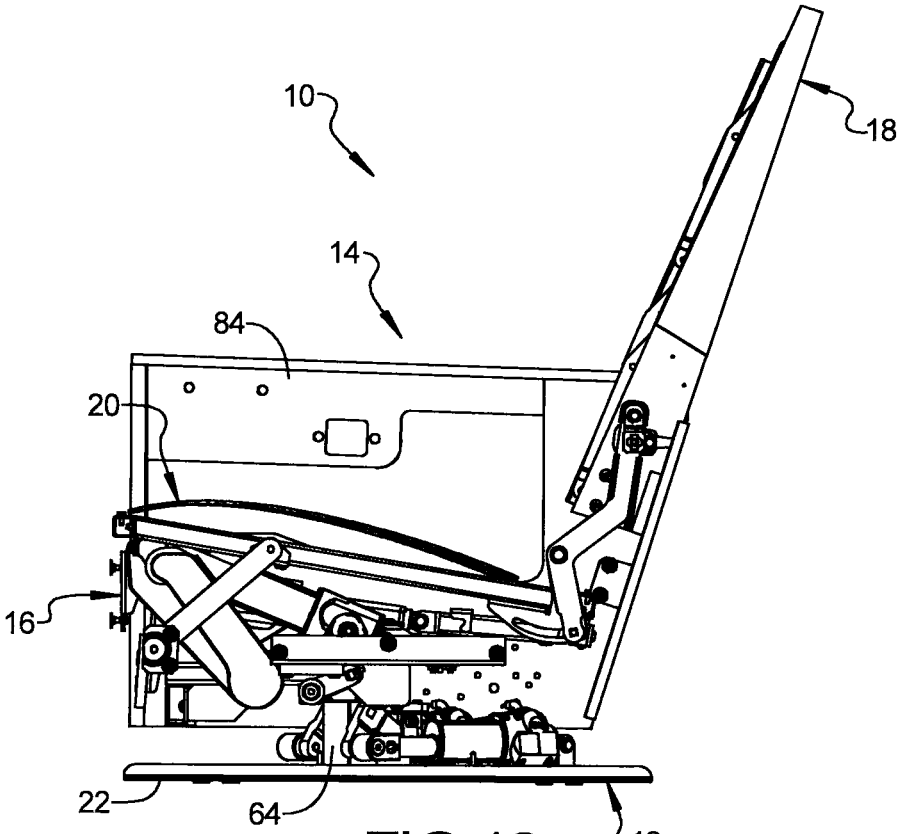
FIG. 12 is a side view of the furniture member (with one of the armrest members removed for illustration purposes) with the seat assembly in a swiveled position.
Figure 13:
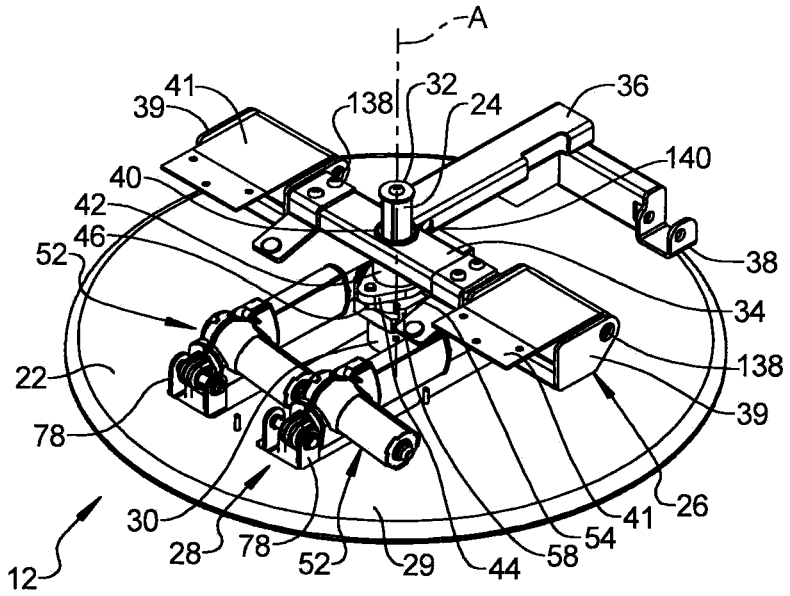
FIG. 13 is a perspective view of a base assembly of the furniture member in a lowered position.

The seat bottom 20 may include a front frame member 90, a rear frame member 92, and a pair of side frame members 94 that extend between and are fixedly attached to the front and rear frame members 90, 92. Seat springs 96 may be attached to and extend between the front and rear frame members 90, 92. As shown in FIGS. 2 and 11, a cushion and upholstery 91 may be supported by the springs 96. The seat bottom 20 may be movably coupled to the armrest members 84 by links 98. Each link 98 is rotatably connected to a respective one of the armrest members 84 and to a respective one of the side frame members 94.

The seat assembly 14 may include a recline actuator 100 (FIG. 1) that extends between the cross member 86 and the front frame member 90. As will be described in more detail below, the recline actuator 100 is operable to move the seat bottom 20 forward and rearward relative to the seat base frame 82 (i.e., the cross member 86 and the armrest members 84), which cases the seatback 18 to move between the non-reclined position (FIGS. 1-6) and the reclined position (FIGS. 7 and 8).

Figure 21:
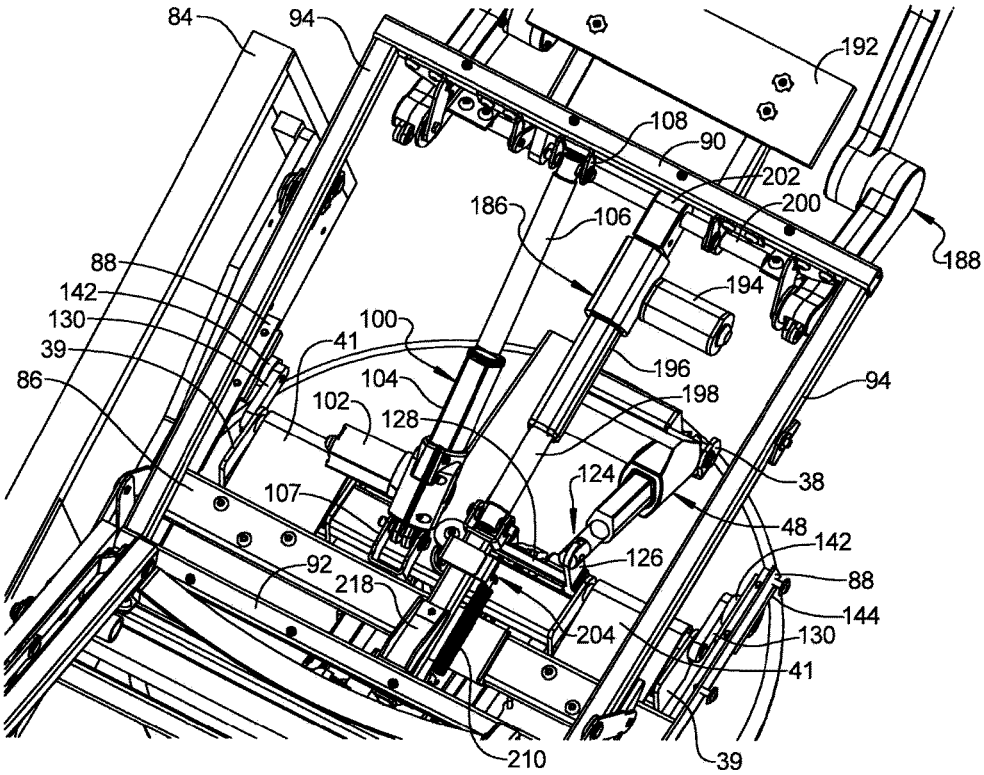
FIG. 21 is another partial perspective view of the furniture member (with one of the armrest members removed for illustration purposes) in the rearward tilted and reclined position and with the legrest assembly in the extended position.

As shown in FIG. 21, the recline actuator 100 may include a motor 102, a cylinder 104, and a piston 106. The cylinder 104 is pivotably coupled to a bracket 107 mounted on the cross member 86. The piston 106 is pivotably coupled to a bracket 108 mounted on the front frame member 90 of the seat bottom 20. The piston 106 is received in the cylinder 104 and the piston 106 and cylinder 104 are movable linearly relative to each other between a retracted position (FIGS. 1, 3, and 5) and an extended position (FIG. 7). The motor 102 can be any suitable type of electromechanical motor, for example, and is operable to drive the piston 106 and to the cylinder 104 relative to each other.

As shown in FIG. 1, the seatback frame 97 is coupled to the side frame members 94 of the seat bottom 20 by a pair of levers 110 and a pair of slide members 112. A first end 114 of each lever 110 may be fixedly attached to the seatback frame 97. An intermediate portion 116 of each lever 110 may be rotatably engaged with a respective one of the slide members 112 (e.g., by a pin or fastener extending through the intermediate portion 116 and the slide member 112). A second end 118 of each lever 110 may include a protrusion 120 (e.g., pin, threaded fastener or rivet) that is slidably engaged with a curved slot 122 formed in a respective one of the slide members 112.

As the recline actuator 100 moves from the retracted position to the extended position, the front frame member 90 of the seat bottom 20 is pushed further away from the cross member 86. That is, as the recline actuator 100 moves from the retracted position to the extended position, the seat bottom 20 is moved forward relative to the armrest members 84 (compare FIGS. 6 and 8). The links 98 connected to the armrest members 84 and the side frame members 94 rotate as the seat bottom 20 is moved relative to the armrest members 84.

The movement of the seat bottom 20 relative to the armrest members 84 is transmitted to the seatback 18, thereby causing the seatback 18 to recline relative to the armrest members 84. That is, when the seat bottom 20 moves forward relative to the armrest members 84, the protrusions 120 attached to levers 110 slide within the slots 122 of the slide members 112 and the levers 110 rotate relative to the slide members 112 to cause the seatback 18 to rotate relative to the armrest members 84 from the non-reclined position (FIG. 6) to the reclined position (FIG. 8).

As the recline actuator 100 moves from the extended position to the retracted position, the front frame member 90 of the seat bottom 20 is pulled toward the cross member 86, thereby moving the seat bottom 20 rearward relative to the armrest members 84. This movement of the seat bottom 20 causes the seatback 18 to rotate relative to the armrest members 84 from the reclined position (FIG. 8) to the non-reclined position (FIG. 6).

Figure 22:
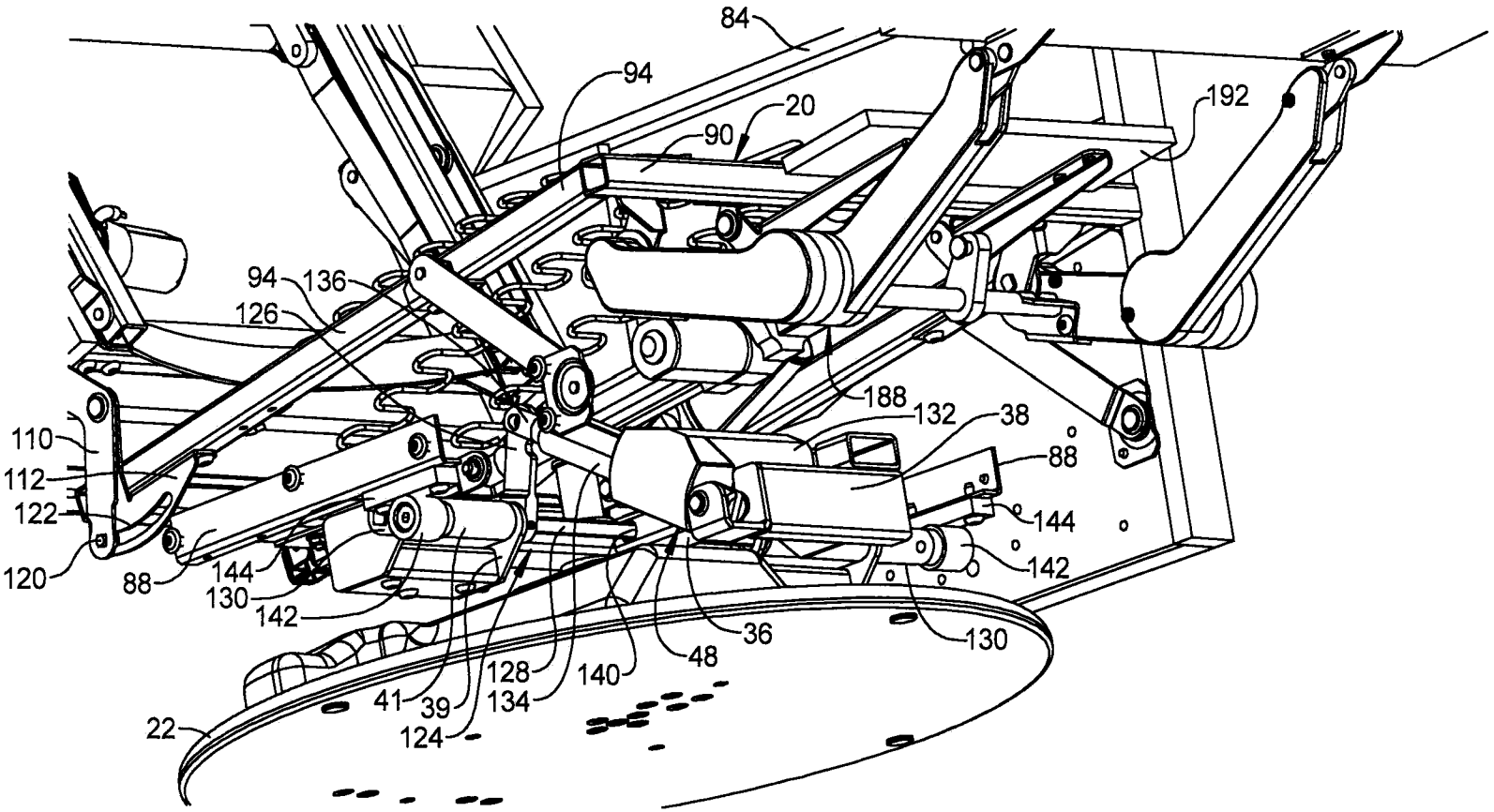
FIG. 22 is a partial perspective view of the furniture member (with one of the armrest members removed for illustration purposes) in the upright and non-reclined position and with the legrest assembly in the extended position.
Figure 23:
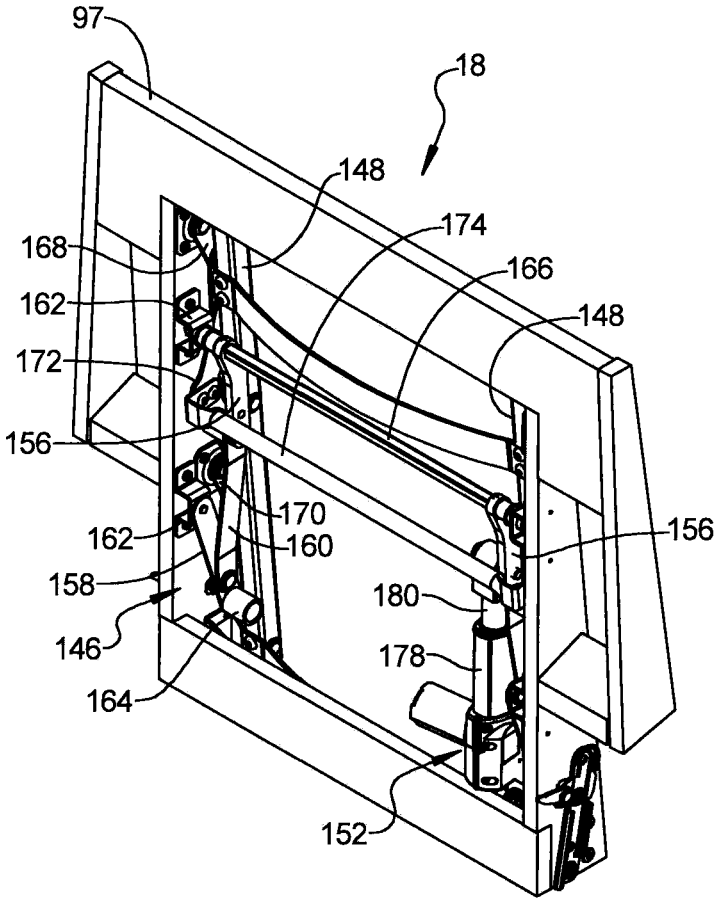
FIG. 23 is a perspective view of the seatback of the furniture member with the seat-depth-adjustment mechanism in a rearward-retracted position.

As described above, the tilt actuator 48 is operable to move the seat assembly 14 relative to the base assembly 12 between an upright position (FIGS. 1 and 2) and a rearward tilted position (FIGS. 5-8). That is, a tilt mechanism 124 (which includes the tilt actuator 48) moves the base assembly 12 between the upright and rearward tilted positions. As shown in FIGS. 20-22, the tilt mechanism 124 also includes a first crank link 126, a drive rod 128, and a pair of second crank links 130.

As shown in FIG. 20, the tilt actuator 48 may include a motor 132, a cylinder 134, and a piston 136. The cylinder 134 is rotatably attached to bracket 38 of the support frame 26 of the base assembly 12. The piston 136 is received in the cylinder 134, and the piston 136 is movable linearly relative to the cylinder 134 between a retracted position (FIG. 22) and an extended position (FIGS. 20 and 21). The motor 132 can be any suitable type of electromechanical motor, for example, and is operable to drive the piston 136 relative to the cylinder 134.

The piston 136 is rotatably coupled to an end of the first crank link 126. The other end of the first crank link 126 is fixedly coupled to the drive rod 128. The drive rod 128 may have a square (or other suitable shape) cross-sectional profile to fixedly engage the first crank link 126 and the second crank links 130. The drive rod 128 may extend through apertures 138 (FIGS. 13 and 14) in the plates 43 of the brackets 39 of the base assembly 12 and through an aperture 140 in the brace member 36 of the base assembly 12. The drive rod 128 is rotatable within the apertures 138, 140 (the drive rod 128 may include cylindrical bushings (not shown) that facilitate rotation of the drive rod 128 within the apertures 138, 140). As shown in FIGS. 20-22, one end of each second crank link 130 is fixedly coupled to the drive rod 128 and the other end of each crank link 130 may include a roller 142 that rollingly engages a block 144 mounted to the angle bracket 88 fixed to the corresponding armrest member 84 (i.e., the rollers 142 roll along an outer surface of the blocks 144 or the angle brackets 88).

Operation of the motor 132 of the tilt actuator 48 in one direction moves the piston 136 of the tilt actuator 48 from the retracted position (FIG. 22) to the extended position (FIGS. 20 and 21). Such movement of the piston 136 causes the first crank link 126, the drive rod 128 and the second crank links 130 to all rotate together (i.e., since the first crank link 126, the drive rod 128 and the second crank links 130 are all rotationally fixed to each other) about a longitudinal axis of the drive rod 128 (i.e., an axis extending through opposing ends of the drive rod 128). Such rotation of the second crank links 130 causes the rollers 142 to push upward on the blocks 144 and angle brackets 88, which causes the armrest members 84 (and thus, the entire seat assembly 14) to tilt rearward toward the rearward tilted position (FIGS. 5 and 6). Such rearward tilting motion flexes the rocking springs 41 to a rearward rocked position shown in FIG. 17. Operation of the motor 132 of the tilt actuator 48 in the opposite direction moves the piston 136 of the tilt actuator 48 from the extended position to the retracted position, which rotates the first crank link 126, the drive rod 128 and the second crank links 130 in the opposite direction to allow the rocking springs 41 to unflex to return the seat assembly 14 from the rearward tilted position to the upright position (FIGS. 1-4).

The seatback 18 includes a seat-depth-adjustment mechanism 146 that is operable to adjust a seat depth by moving a portion of the seatback 18 forward (FIGS. 10 and 11) and backward (FIGS. 1 and 2) relative to the seat bottom 20. As shown in FIGS. 23-27, the seat-depth-adjustment mechanism 146 may include one or more backrest support members 148, a pair of drive linkages 150, a pair of guide linkages 151, and a seat-depth-adjustment actuator 152. The backrest support members 148 may be elongated beams that are positioned parallel to each other. The backrest support members 148 may support springs and/or a cushion that form a backrest against which an occupant of the furniture member 10 may rest his or her back when seated in the furniture member 10. As shown in FIGS. 26 and 27, upholstery (e.g., leather, fabric etc.) 155 may be wrapped around the seat-depth-adjustment mechanism 146, the seatback frame 97 and the backrest springs and/or backrest cushion (the springs and/or cushion is disposed between the upholstery 155 and the backrest support members 148). The upholstery 155 may include resiliently stretchable portions 157 that allow for the relative movement between the backrest support members 148 and the seatback frame 97. The resiliently stretchable portions 157 may be formed from a different material than other portions of the upholstery (i.e., the forward-facing portion of the upholstery 155 against which an occupant of the furniture member 10 would rest his or her back when seated in the furniture member 10). That is, the resiliently stretchable portions 157 are formed from a material with higher elasticity than the material of other portions of the upholstery 155. In some configurations, the portions 157 may be foldable (instead of or in addition to being resiliently stretchable) to allow for the relative movement between the backrest support members 148 and the seatback frame 97.

Figure 24:
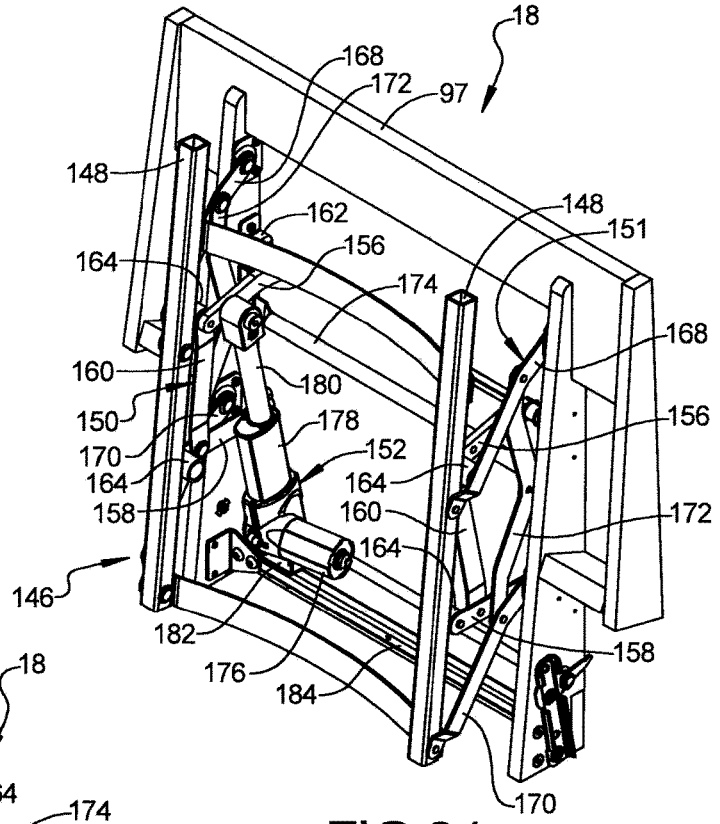
FIG. 24 is a perspective view of the seatback of the furniture member with the seat-depth-adjustment mechanism in the forward-extended position.
Figure 25:
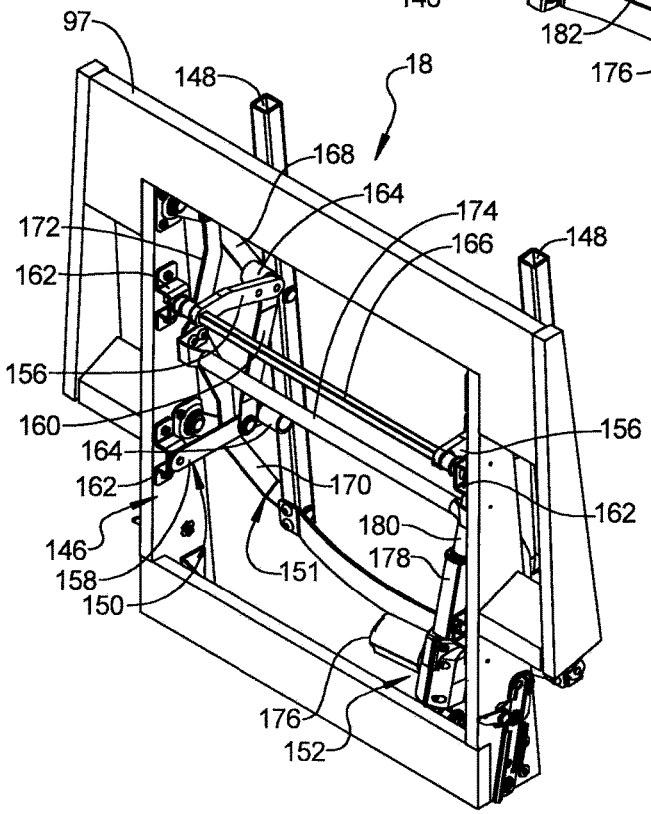
FIG. 25 is another perspective view of the seatback of the furniture member with the seat-depth-adjustment mechanism in the forward-extended position.
Figure 26:
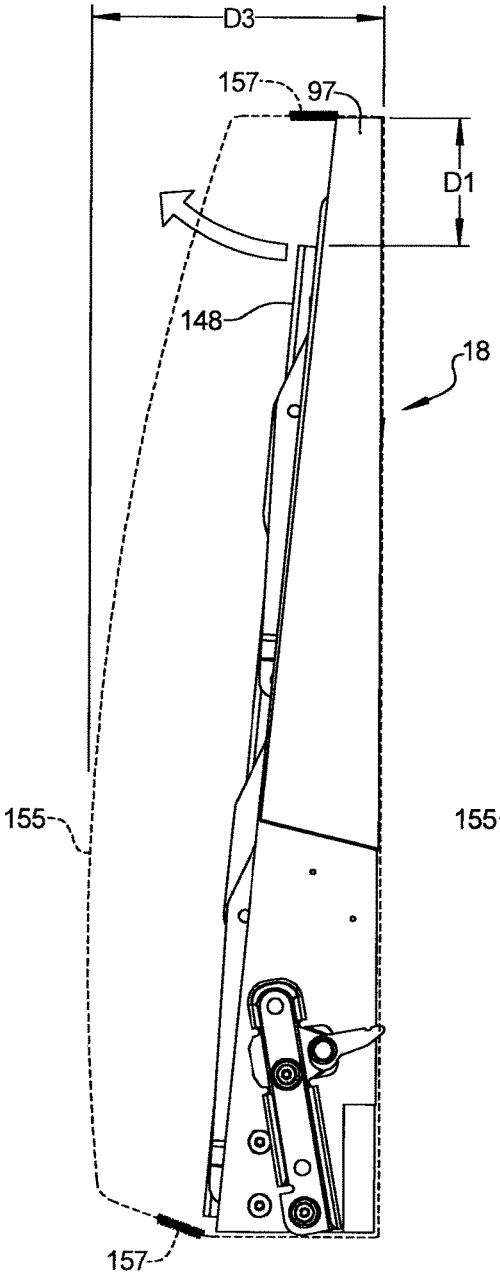
FIG. 26 is a side view of the seatback of the furniture member with the seat-depth-adjustment mechanism in the rearward-retracted position.
Figure 27:
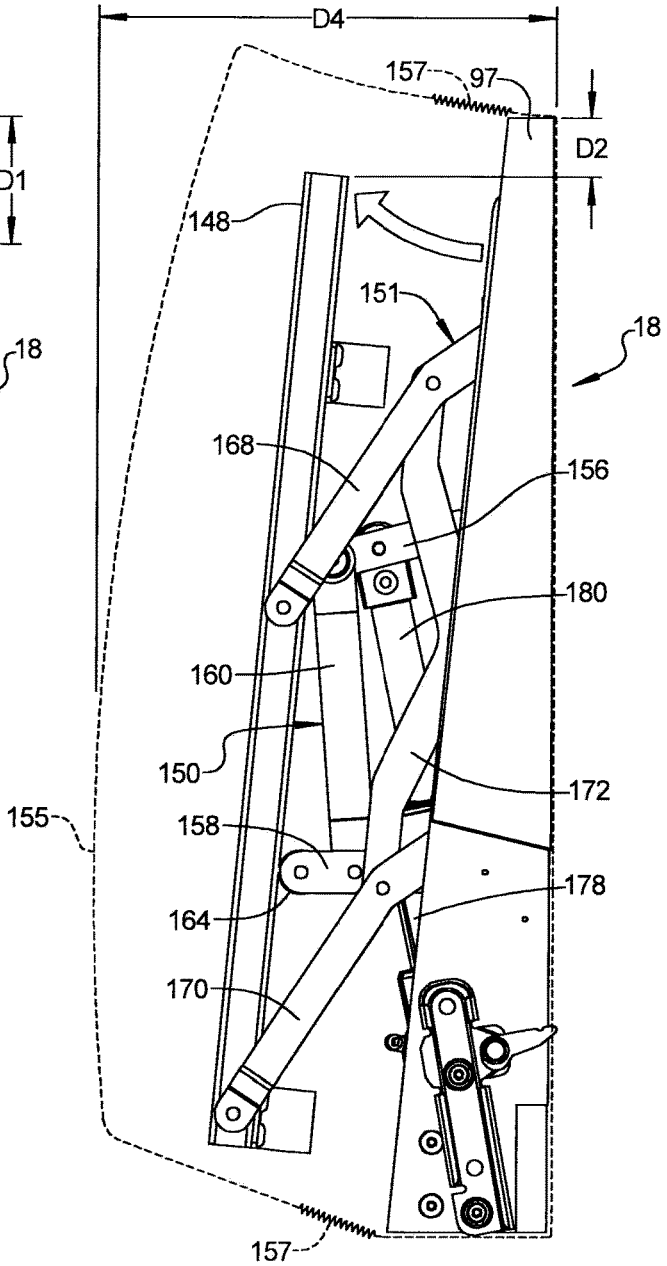
FIG. 27 is a side view of the seatback of the furniture member with the seat-depth-adjustment mechanism in the forward-extended position.

As shown in FIGS. 23-27, each of the drive linkages 150 may include a first drive link 156, a second drive link 158, and a connector link 160. First ends of the first and second drive links 156, 158 are rotatably coupled to spacers 162 mounted to the seatback frame 97. Second ends of the first and second drive links 156, 158 have rollers 164. The rollers 164 may rollingly contact the backrest support members 148 (i.e., the rollers 164 roll along an outer surface of the backrest support members 148). The connector link 160 of each drive linkage 150 is rotatably connected to the respective first and second drive links 156, 158. A drive rod 166 is rotationally fixed to the first ends of the first drive links 156. As will be described in more detail below, the seat-depth-adjustment actuator 152 drives one of the first drive links 156 to rotate the links 156, 158, 160 of the drive linkages 150 such that the rollers 164 push the backrest support members 148 from the retracted position (FIGS. 23 and 26) to the extended position (FIGS. 24, 25, and 27).

As shown in FIGS. 23-27, each of the guide linkages 151 may include a first guide link 168, a second guide link 170, and a connector link 172. First ends of the first guide links 168 are rotatably coupled to the seatback frame 97. Second ends of the first guide links 168 are rotatably coupled to respective backrest support members 148. First ends of the second guide links 170 are rotatably coupled to the seatback frame 97. Second ends of the second guide links 170 are rotatably coupled to respective backrest support members 148. The connector link 172 of each guide linkage 151 is rotatably connected to the respective first and second guide links 168, 170. A brace member 174 may be fixed to an intermediate portion of both of the connector links 172 and increases the lateral stiffness of the seat-depth-adjustment mechanism 146.

As shown in FIGS. 24 and 25, the seat-depth-adjustment actuator 152 may include a motor 176, a cylinder 178, and a piston 180. The cylinder 178 is rotatably attached to bracket 182 of a support beam 184 that is fixedly mounted on the seatback frame 97. The piston 180 is received in the cylinder 178, and the piston 180 is movable linearly relative to the cylinder 178 between a retracted position (FIG. 23) and an extended position (FIGS. 24 and 25). The motor 176 can be any suitable type of electromechanical motor, for example, and is operable to drive the piston 180 relative to the cylinder 178. As shown in FIG. 24, the piston 180 is rotatably coupled to one of the first drive links 156.

Operation of the motor 176 of the seat-depth-adjustment actuator 152 in one direction causes the piston to move the extended position, which causes rotation of the drive linkages 150, which pushes the backrest support members 148 outward relative to the seatback frame 97, as described above. Such movement of the backrest support members 148 causes corresponding movement of the guide linkages 151. The movement of the guide linkages 151 guides the backrest support members 148 in a curved path that extends upward and outward, as indicated by the arrows in FIGS. 26 and 27 (i.e., the backrest support members 148 move forward and upward as the seat-depth-adjustment mechanism 146 moves into the forward extended position).

Operation of the motor 176 of the seat-depth-adjustment actuator 152 in the opposite direction causes the piston to move the retracted position, which allows the seat-depth-adjustment mechanism 146 to be returned to the rearward retracted position. In some configurations, springs (not shown) and/or the resiliently stretchable portions 157 of the upholstery 155 surrounding the seatback 18 may urge the backrest support members 148 and the linkages 150, 151 toward the rearward retracted position.

When the seat-depth-adjustment mechanism 146 is in the forward extended position, an effective depth of the seat bottom 20 (i.e., a fore-aft distance between the front edge of the seat bottom 20 and the backrest support members 148) is reduced (as shown in FIG. 11), and when the seat-depth-adjustment mechanism 146 is in the forward extended position, an effective depth of the seat bottom 20 is reduced (as shown in FIG. 2).

As shown in FIG. 26, an upper edge of the backrest support members 148 is a first distance D1 (in a direction parallel to the longitudinal axis of the backrest support members 148) from the upper edge of the seatback frame 97 when the seat-depth-adjustment mechanism 146 is in the rearward retracted position. Furthermore, a rear edge of the seatback frame 97 is a third distance D3 (in a direction perpendicular to the first distance D1) from a forward-most point of upholstery 155 when the seat-depth-adjustment mechanism 146 is in the rearward retracted position. As shown in FIG. 27, the upper edge of the backrest support members 148 is a second distance D2 (in a direction parallel to the longitudinal axes of the backrest support members 148) from the upper edge of the seatback frame 97 when the seat-depth-adjustment mechanism 146 is in the forward extended position. Furthermore, the rear edge of the seatback frame 97 is a fourth distance D4 (in a direction perpendicular to the first distance D1) from the forward-most point of upholstery 155 when the seat-depth-adjustment mechanism 146 is in the forward extended position. The second distance D2 is less than the first distance D1, and the fourth distance D4 is greater than the third distance D3 (for example, the difference between the third distance D3 and the fourth distance D4 may be approximately 2-5 inches or approximately 2-4 inches or approximately 3-4 inches). In this manner, the backrest support members 148 (as well as the backrest cushion and upholstery connected to the backrest support members 148) moves upward relative to the seat bottom cushion and upholstery 91 attached to the seat bottom 20 as the backrest support members 148 move forward toward the front frame member 90 of the seat bottom 20. This reduces or prevents excessive friction between the seatback upholstery and the seat bottom upholstery 91 during movement of the seat-depth-adjustment mechanism 146, thereby reducing or preventing undesirable upholstery wear.

In other configurations of the furniture member 10, the seat-depth-adjustment mechanism 146 could be configured so that the backrest support members 148 translate linearly (rather than in the curved path described above) in a direction perpendicular to the longitudinal axes of the backrest support members 148. In still other configurations of the furniture member 10, the seat-depth-adjustment mechanism 146 could be configured so that the backrest support members 148 rotate about a rotational axis extending through upper ends of the backrest support members 148.

Figure 3:
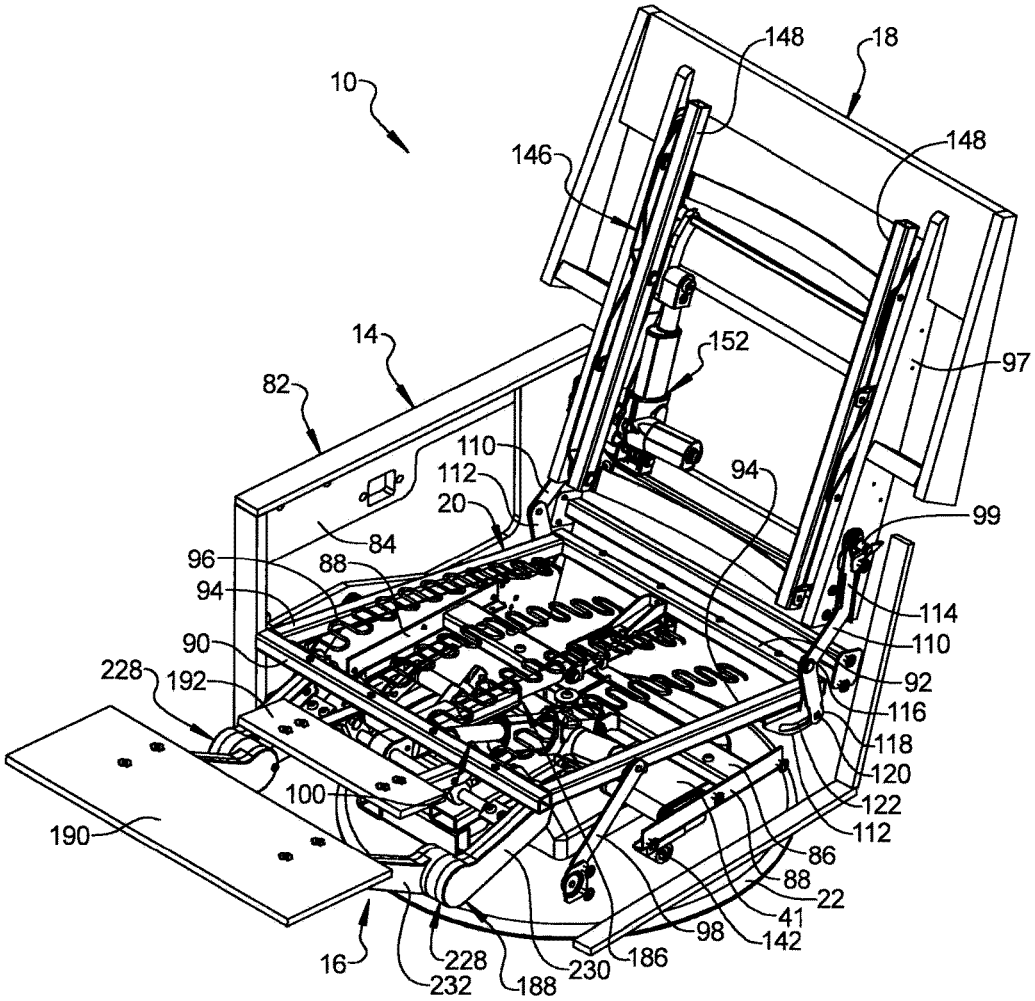
FIG. 3 is a perspective view of the furniture member (with one of the armrest members removed for illustration purposes) with the seat assembly in an upright and non-reclined position and with the legrest assembly in an extended position.
Figure 4:
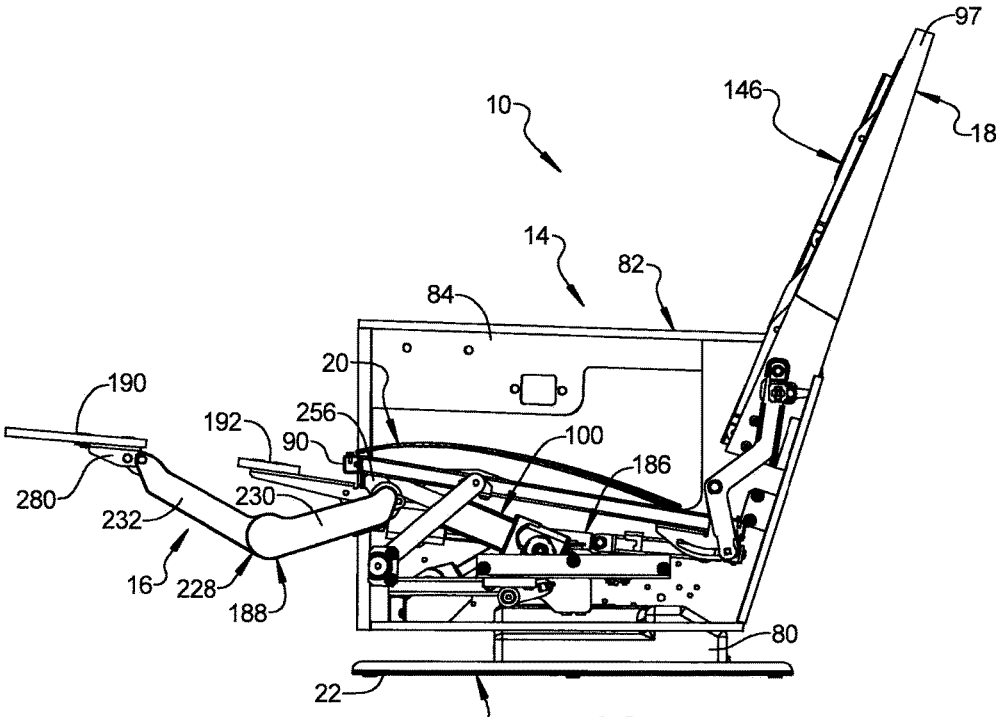
FIG. 4 is a side view of the furniture member (with one of the armrest members removed for illustration purposes) in the positions of FIG. 3.
Figure 28:
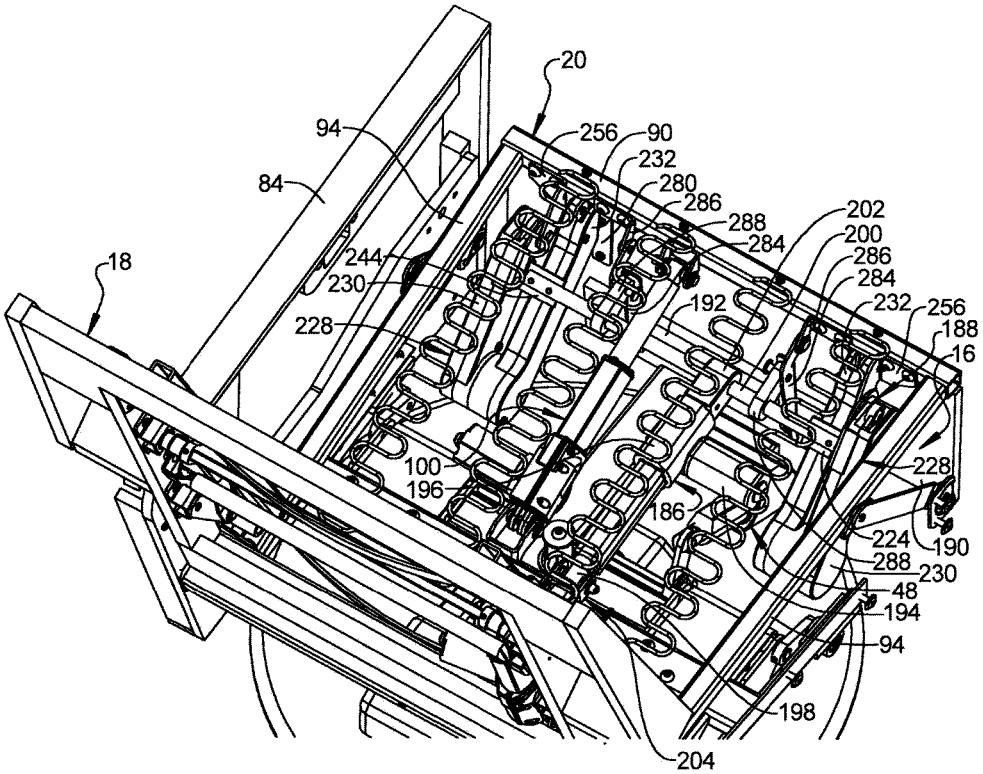
FIG. 28 is a partial perspective view of the furniture member (with one of the armrest members removed for illustration purposes) in the upright and non-reclined position and with the legrest assembly in the retracted position.
Figure 29:
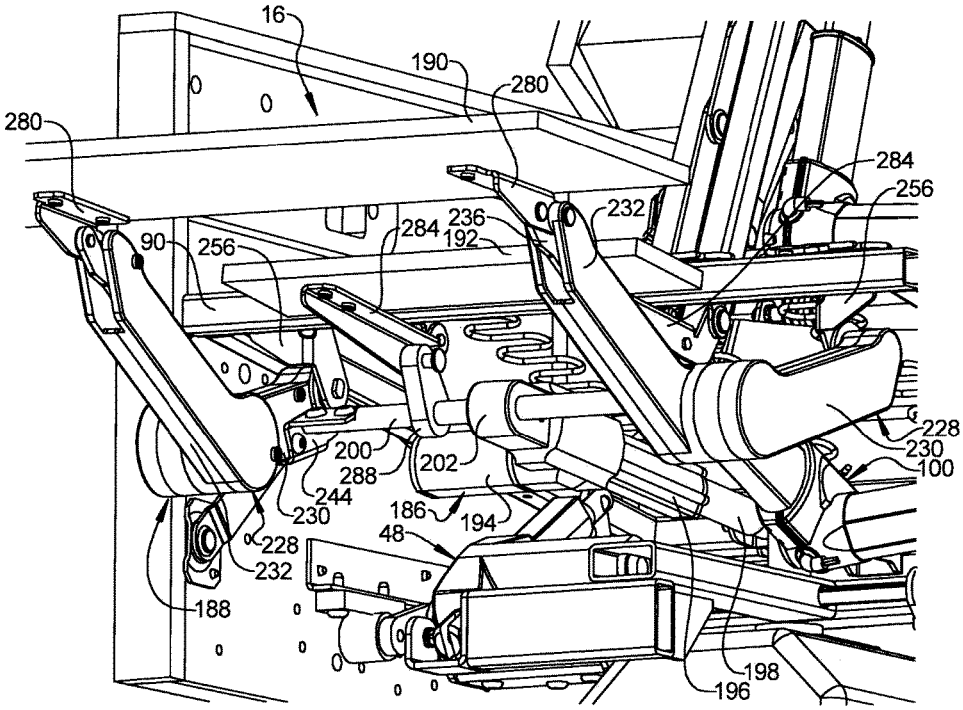
FIG. 29 is a partial perspective view of the furniture member (with one of the armrest members removed for illustration purposes) in the upright and non-reclined position and with the legrest assembly in the extended position.

As described above, the legrest assembly 16 is movable relative to the seat assembly 14 between a retracted position (FIGS. 1, 2 and 28) and an extended position (FIGS. 3, 4 and 29). As shown in FIGS. 3, 4, 28 and 29, the legrest assembly 16 may include a legrest actuator 186, a legrest mechanism 188, a legrest platform 190, and a mid-ottoman platform 192.

As shown in FIGS. 28 and 29, the legrest actuator 186 may include a motor 194, a cylinder 196, and a piston 198. The cylinder 196 and motor 194 are pivotably coupled to a push bar 200 of the legrest mechanism 188 by a bracket 202. The piston 198 is received in the cylinder 196 and the piston 198 and cylinder 196 are movable linearly relative to each other between a retracted position (FIG. 28) and an extended position (FIG. 29). The motor 194 can be any suitable type of electromechanical motor, for example, and is operable to drive the piston 198 and the cylinder 196 relative to each other. The piston 198 is pivotably coupled to a compliant bracket assembly 204 (FIGS. 30 and 31) mounted to the rear frame member 92 of the seat bottom 20.

Figure 30:
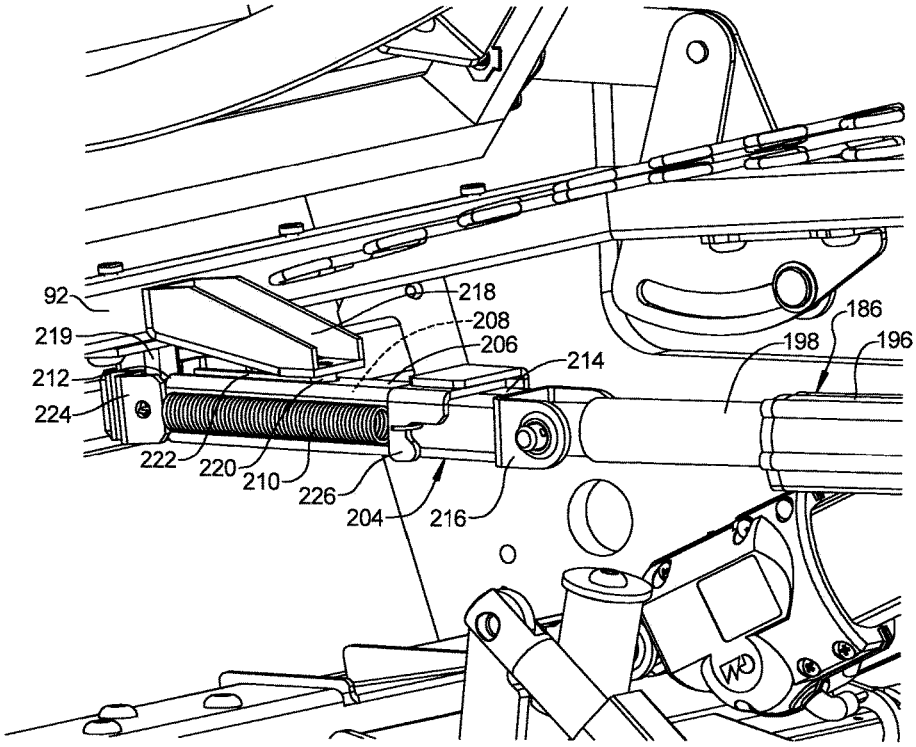
FIG. 30 is a partial perspective view of the furniture member (with components removed for illustration purposes) depicting a compliant bracket assembly of the legrest assembly.
Figure 31:
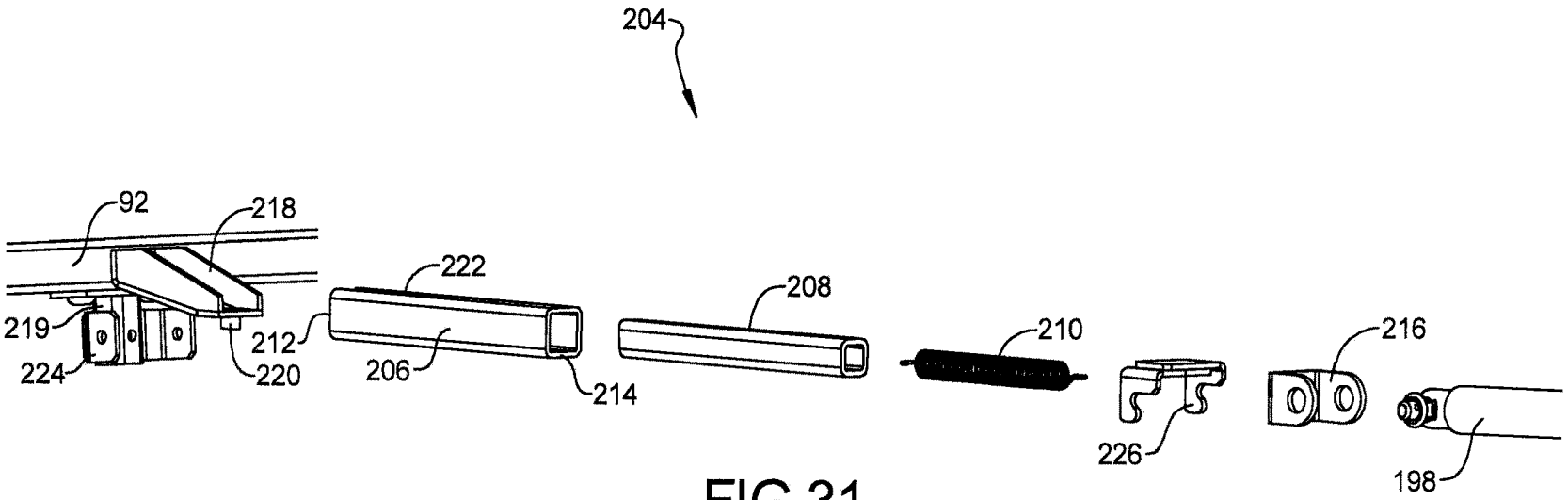
FIG. 31 is an exploded view of the compliant bracket assembly of FIG. 30.

As shown in FIGS. 30 and 31, the compliant bracket assembly 204 may include a hollow tube 206, a bar 208, and one or more springs 210. The tube 206 may have a square or rectangular cross-sectional profile and may include an open first end 212 and a second end 214 having a bracket 216 to which the piston 198 is pivotably connected. The bar 208 may be an elongated member having a square or rectangular cross-sectional profile and may be slidably received within the tube 206 through the open first end 212. The bar 208 may be fixedly attached to the rear frame member 92 of the seat bottom 20 or to a stud 219 extending from the rear frame member 92. A support bracket 218 may be attached to the rear frame member 92 and may fixedly engage the bar 208 via a pin 220 that extends through a slot 222 formed in the tube 206. One end of the spring 210 may engage a first spring bracket 224 fixed to the rear frame member 92 and/or the bar 208. The other end of the spring 210 may engage a second spring bracket 226 fixed to the tube 206.

The motor 194 is operable in a first direction to move the cylinder 196 relative to the piston 198 from the retracted position to the extended position to cause movement of the legrest mechanism 188 to move the legrest platform 190 from the retracted position (FIGS. 1, 2 and 28) to the extended position (FIGS. 3, 4 and 29). Similarly, operation of the motor 194 in a second direction (opposite the first direction) to move the cylinder 196 relative to the piston 198 from the extended position to the retracted position causes movement of the legrest mechanism 188 and the legrest platform 190 from the extended position (FIGS. 3, 4 and 29) to the retracted position (FIGS. 1, 2 and 28). If sufficiently large resistance is encountered during movement of the legrest mechanism 188 and legrest platform 190 toward the retracted position (e.g., due an obstruction blocking the path of movement of legrest mechanism 188 and legrest platform 190 toward the retracted position), the spring 210 of the compliant bracket assembly 204 will stretch to allow the tube 206 to slide along the bar 208. When the obstruction is removed, the spring 210 will contract to pull the tube 206 rearward toward the stud 219 to allow the legrest mechanism 188 and legrest platform 190 to continue moving toward the retracted position.

As shown in FIGS. 28 and 29, the legrest mechanism 188 may include the push bar 200 and a pair of articulating arm assemblies 228. As shown in FIGS. 32-38, each of the articulating arm assemblies 228 may include a first link-housing 230 (FIGS. 32 and 33), a second link-housing 232 (FIGS. 32 and 33), a first lug member 231 (FIGS. 34, 35, and 37), a second lug member 233 (FIGS. 34, 35, and 37), a first control link 234 (FIGS. 34, 35 and 37), and a second control link 236 (FIGS. 34, 36 and 38).

Figure 32:
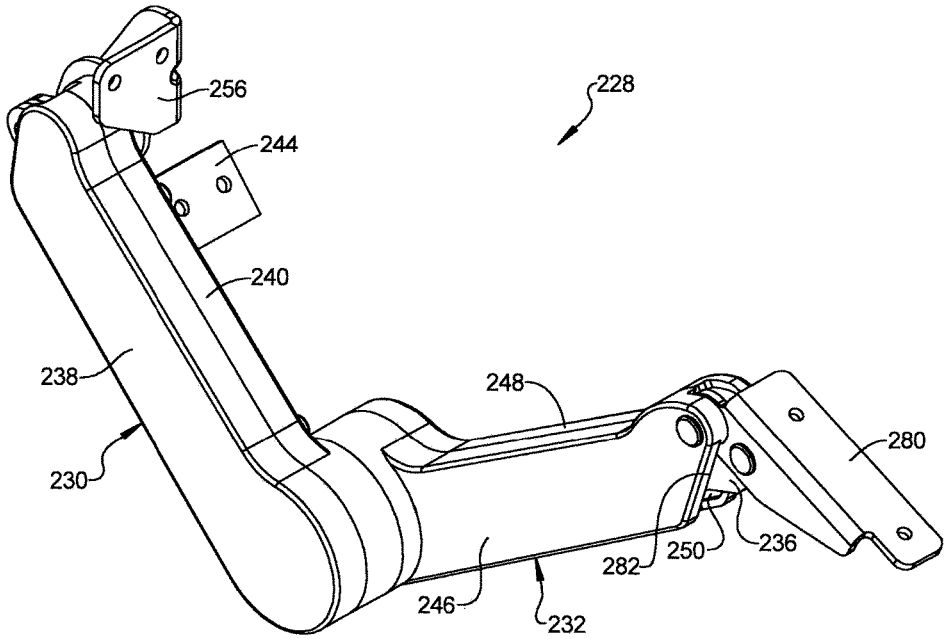
FIG. 32 is a perspective view of an articulating arm assembly of the legrest assembly in an extended position.
Figure 33:
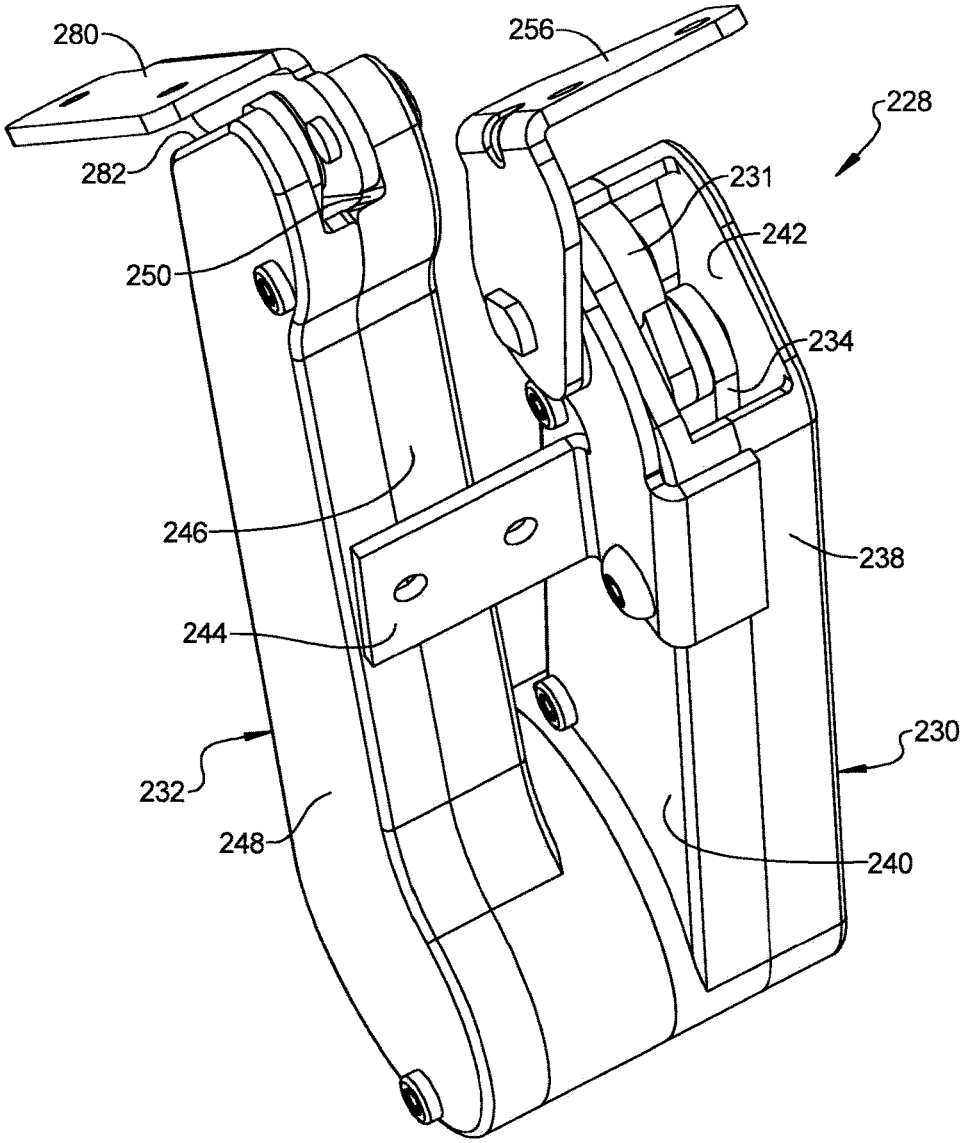
FIG. 33 is a perspective view of the articulating arm assembly of the legrest assembly in a retracted position.
Figure 34:
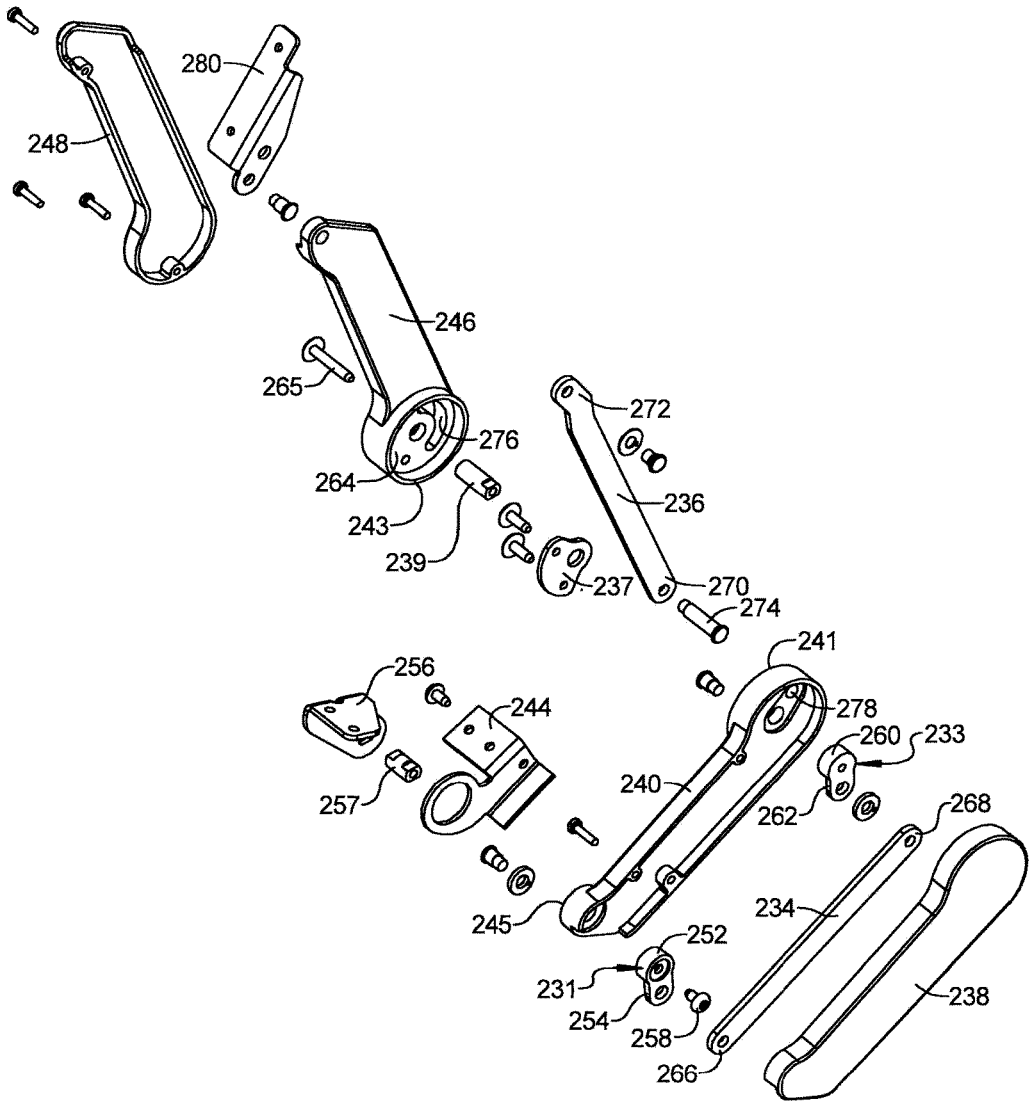
FIG. 34 is an exploded view of the articulating arm assembly.

The first link-housing 230 may include a first housing member 238 (FIGS. 32 and 33) and a second housing member 240 (FIGS. 32-38) that are fixedly attached to each other (e.g., via bolts or other fasteners, welding, adhesive, etc.) and define an enclosed (or mostly enclosed) internal cavity 242 (FIG. 33). The first control link 234 is movably disposed within the internal cavity 242 (i.e., the first control link 234 is movable within the internal cavity 242 relative to the first link-housing 230). A push-bar-bracket 244 may be fixedly attached to the second housing member 240. As shown in FIGS. 28 and 29, the push bar 200 may be fixedly attached to the push-bar-brackets 244 of both articulating arm assemblies 228.

The second link-housing 232 may include a third housing member 246 (FIGS. 32 and 33) and a fourth housing member 248 (FIGS. 32-38) that are fixedly attached to each other (e.g., via bolts or other fasteners, welding, adhesive, etc.) and define an enclosed (or mostly enclosed) internal cavity 250 (FIGS. 32 and 33). The second control link 236 is movably disposed within the internal cavity 250 (i.e., the second control link 236 is movable within the internal cavity 250 relative to the second link-housing 232).

Figure 35:
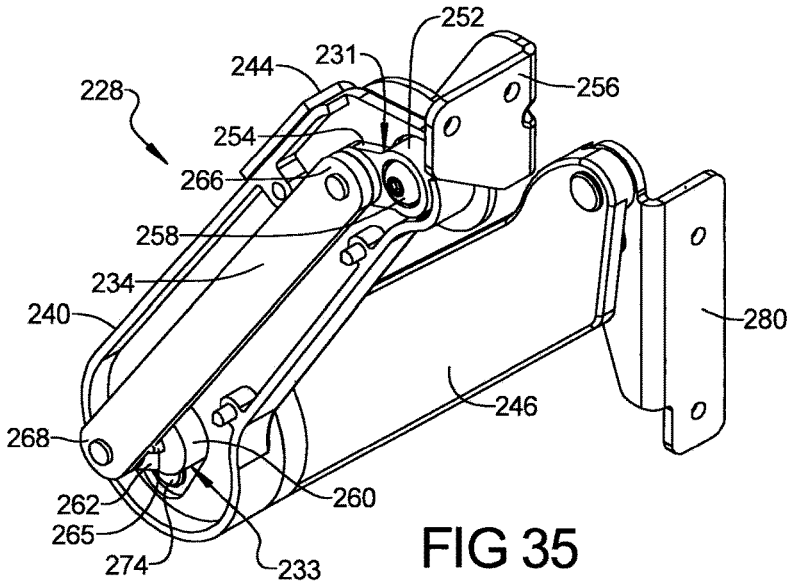
FIG. 35 is a perspective view of the articulating arm assembly (with housing members removed for illustration purposes) of the legrest assembly in the retracted position.
Figure 36:
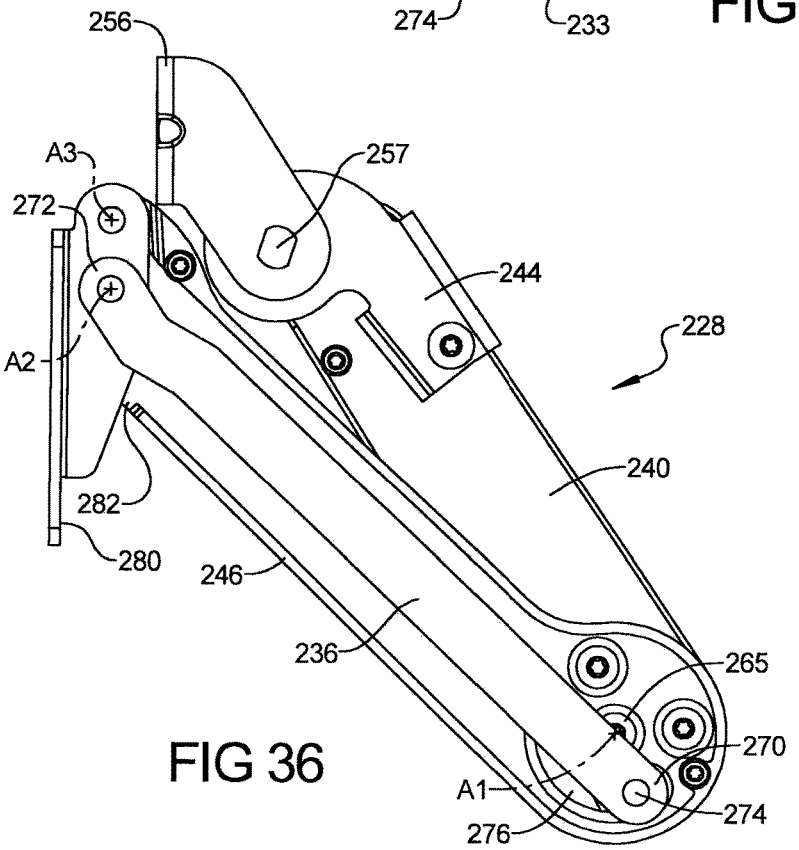
FIG. 36 is a side view of the articulating arm assembly (with housing members removed for illustration purposes) of the legrest assembly in the retracted position.
Figure 37:
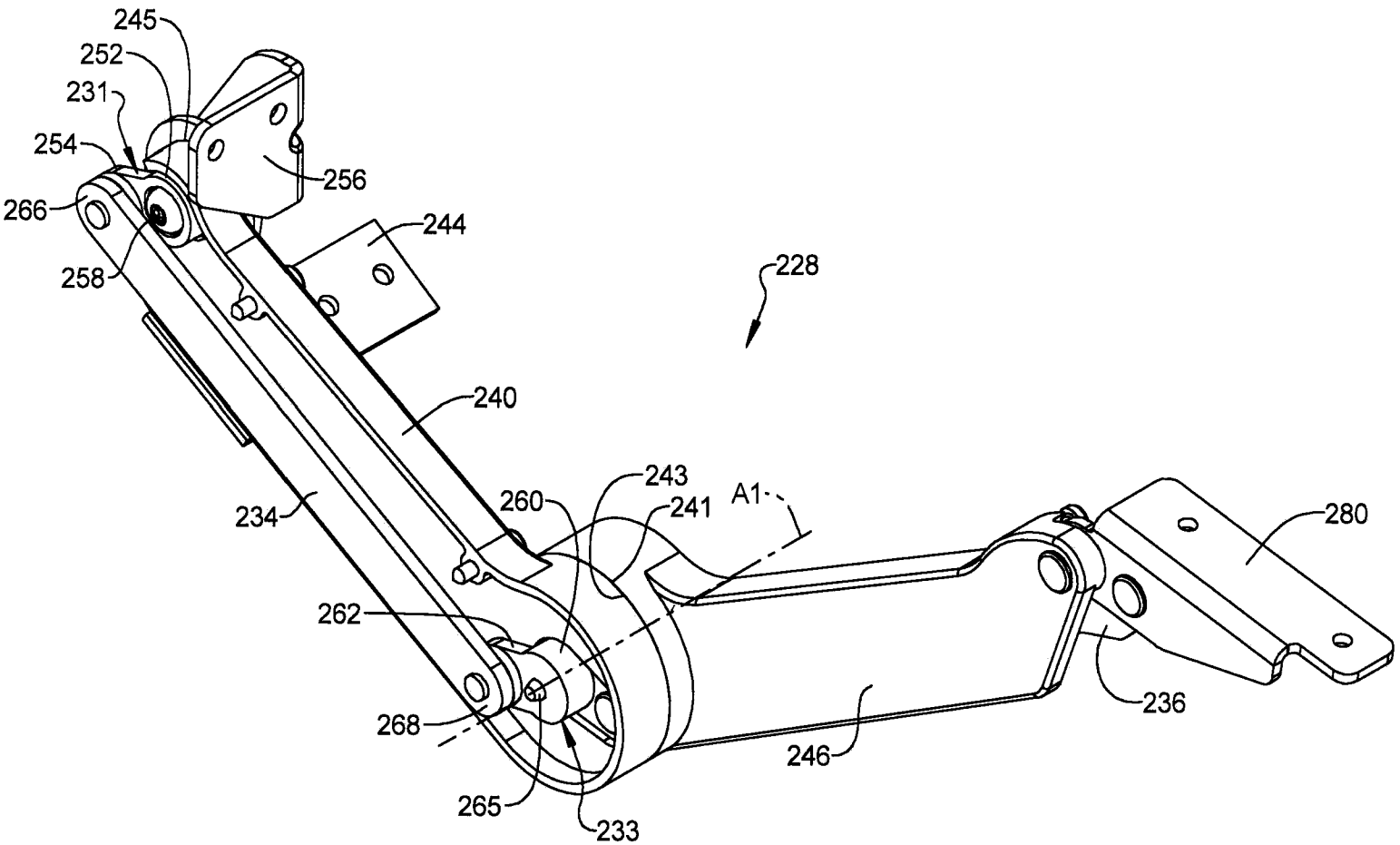
FIG. 37 is a perspective view of the articulating arm assembly (with housing members removed for illustration purposes) of the legrest assembly in the extended position.
Figure 38:
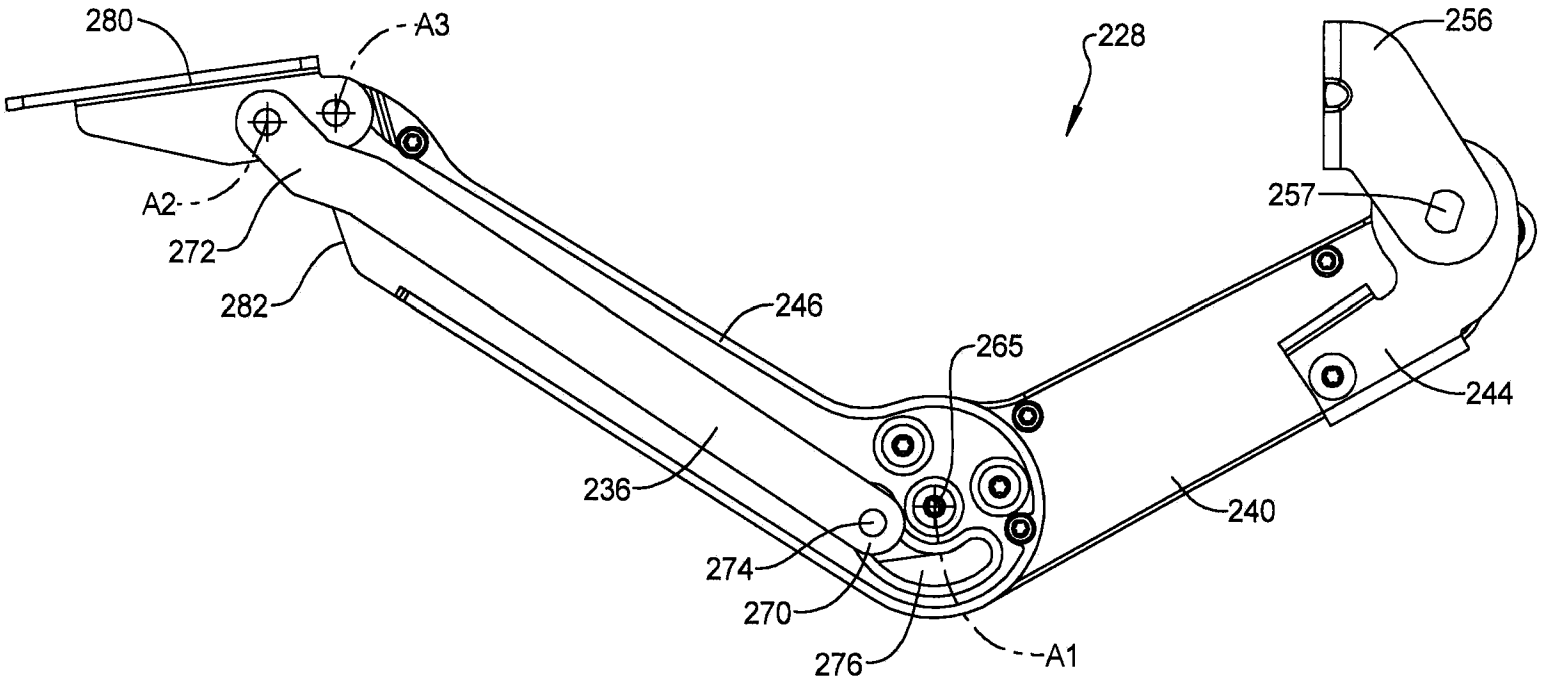
FIG. 38 is a side view of the articulating arm assembly (with housing members removed for illustration purposes) of the legrest assembly in the extended position.

As shown in FIGS. 35 and 37, the first lug member 231 includes a generally cylindrical hub 252 and an arm 254 extending radially outward from the hub 252. The hub 252 is rotatably coupled to the first link-housing 230 (specifically, the second housing member 240 of the first link-housing 230) and fixedly coupled to a seat attachment bracket 256. The seat attachment bracket 256 may be fixedly attached to the front frame member 90 of the seat bottom 20, as shown in FIGS. 28 and 29. The seat attachment bracket 256 is rotationally fixed to the cylindrical hub 252 by a keyed shaft 257 (FIG. 34) (i.e., one end of the keyed shaft 257 is non-rotatably received in the cylindrical hub 252 and the other end of the keyed shaft 257 is non-rotatably received in the seat attachment bracket 256). The first link-housing 230 is rotatable relative to the seat attachment bracket 256 and first lug member 231 about a lug fastener or pin 258. The lug fastener or pin 258 may be received in the keyed shaft 257.

As shown in FIGS. 35 and 37, the second lug member 233 includes a generally cylindrical hub 260 and an arm 262 extending radially outward from the hub 260. The hub 260 is rotatably coupled to the first link-housing 230 (specifically, the second housing member 240 of the first link-housing 230) and fixedly coupled (e.g., via keyed shaft 239 shown in FIG. 34) to a joint plate 237 that is fixedly attached to (or integrally formed with) the second link-housing 232. Specifically, the joint plate 237 is mounted within a recess 264 (FIG. 34) in the third housing member 246 and is disposed between the second and third housing members 240, 246. The second lug member 233 is rotatable relative to the first link-housing 230 and fixed relative to the second link-housing 232. Therefore, the first and second link-housings 230, 232 are rotatable relative to each other about a rotational axis A1. The rotational axis A1 is a longitudinal axis of the hub 260 of the second lug member 233 and a fastener or pin 265 that couples the third housing member 246 to the joint plate 237 and the hub 260.

As shown in FIGS. 34, 35 and 37, the first control link 234 may be an elongated member having a first end 266 and a second end 268. The first end 266 is rotatably coupled to a radially outer end of the arm 254 of the first lug member 231. The second end 268 is rotatably coupled to a radially outer end of the arm 262 of the second lug member 233.

As shown in FIGS. 36 and 38, the second control link 236 may be an elongated member having a first end 270 and a second end 272. The first end 270 rotatably engages a pin 274 (FIGS. 34-36 and 38). The pin 274 extends through an arcuate slot 276 (FIGS. 34, 36 and 38) formed in the third housing member 246 and also extends through an aperture 278 (FIG. 34) formed in the second housing member 240. The pin 274 is slidable along the curved length of the arcuate slot 276, as shown in FIGS. 36 and 38. The arcuate slot 276 curves partially around the fastener 265 and the rotational axis A1 about which the first and second link-housings 230, 232 are rotatable relative to each other.

As shown in FIGS. 36 and 38, the second end 272 of the second control link 236 is rotatably coupled to a platform bracket 280 (i.e., the second control link 236 and the platform bracket 280 are rotatable relative to each other about a rotational axis A2 (FIGS. 36 and 38)). The platform bracket 280 is also coupled to the second link-housing 232 for relative rotation therebetween about another rotational axis A3 that is offset from the rotational axis A2. As shown in FIG. 29, the platform brackets 280 of both articulating arm assemblies 228 fixedly engage and support the legrest platform 190. In some configurations, the platform brackets 280 may be integrally formed with the legrest platform 190.

The second link housing member 240 of the first link-housing 230 may include a first joint-bearing-surface 241 (FIGS. 34 and 37) that encircles the second lug member 233. The third link housing member 246 of the second link-housing 232 may include a second joint-bearing-surface 243 (FIGS. 34 and 37) that encircles the second lug member 233 and rotatably and slidably contacts the first joint-bearing surface 241. The first and second joint-bearing-surfaces 241, 243 may be flat, annular surfaces that cooperate with each other to restrict side-to-side movement of the arm assembly 228 relative to the seat assembly 14. The second link housing member 240 of the first link-housing 230 may include a third joint-bearing-surface 245 (FIGS. 34 and 37) that encircles the keyed shaft 257 and a rotational axis defined by the cylindrical hub 252 (i.e., a rotational axis about which the first link-housing 230 rotates relative to the seat attachment bracket 256). The third joint-bearing-surface 245 may be flat, annular surface that rotatably and slidably contacts the seat attachment bracket 256. The structure of the joint-bearing-surfaces 241, 243, 245 restricts side-to-side movement of the arm assembly 228 relative to the seat assembly 14.

With reference to FIGS. 28, 29 and 32-38, operation of the legrest assembly 16 will be described in detail. As described above, the legrest actuator 186 is attached to the push bar 200, which is attached to the push-bar-brackets 244 of the articulating arm assemblies 228, as shown in FIGS. 28 and 29. Therefore, operation of the legrest actuator 186 moves the push bar 200 relative to the front frame member 90 of the seat bottom 20, which causes the first link-housings 230 of the articulating arm assemblies 228 to rotate about the lug fasteners 258 relative to the first lug members 231, seat attachment brackets 256 and front frame member 90.

Since the seat attachment brackets 256 and the first lug members 231 are always fixed relative to the front frame member 90 of the seat bottom 20 rotation of the first link-housings 230 relative to the front frame member 90 causes corresponding rotation of the first control links 234 relative to the first lug members 231 and the second lug members 233. The relative rotation between the first control links 234 and the second lug members 233 causes corresponding rotation between the first and second link-housings 230, 232. Relative rotation between the first and second link-housings 230, 232 causes the pins 274 attached to the second control links 236 to slide along arcuate slots 276, which moves the second control links 236 relative the second link-housing 232 between a retracted position (shown in FIG. 36; corresponding to the retracted position of the legrest assembly 16 shown in FIGS. 1 and 2) in which the second control links 236 are received further into the second link-housings 232 and an extended position (shown in FIG. 38; corresponding to the extended position of the legrest assembly 16 shown in FIGS. 3 and 4) in which the second control links 236 extend further out of openings 282 of the second link-housings 232. Such movement of the second control links 236 relative to the second link-housings 232 causes rotation of the platform brackets 280 and the legrest platform 190 about the rotational axis A3.

As shown in FIGS. 28 and 29, the mid-ottoman platform 192 is supported by and fixed to a pair of support brackets 284. The support brackets 284 are rotatably coupled to respective mounting brackets 286 (FIG. 28) that are fixed to the front frame member 90 of the seat bottom 20. The support brackets 284 are also rotatably coupled to links 288 that are fixed to the push bar 200. In this manner, movement of the push bar 200 relative to the seat bottom 20 (i.e., due to operation of the legrest actuator 186) causes the links 288 to rotate the support brackets 284 relative to the front frame member 90 to move the mid-ottoman platform 192 between a stowed position (shown in FIG. 28; corresponding to the retracted position of the legrest assembly 16) and a deployed position (shown in FIG. 29; corresponding to the extended position of the legrest assembly 16).

While the legrest assembly 16 is described above as being powered by the legrest actuator 186 with electric motor 194, in some configurations, the articulating arm assemblies 228 may be manually actuated.

As described above, the entire legrest assembly 16 is mounted to the seat bottom 20 (i.e., the legrest actuator 186 is attached to the rear frame member 92 and the articulating arm assemblies 228 are attached to the front frame member 90). In this manner, the legrest assembly 16 moves with the seat bottom when the seat assembly 14 is moved between the tilted and upright positions and when the seat bottom 20 moves forward and rearward during movement of the seatback 18 between the reclined and non-reclined positions. That is, the distance between the seat bottom 20 and the legrest platform 190 does not change regardless of the position of the seat bottom 20. This is particularly beneficial when the seat bottom 20 moves forward and rearward (i.e., during movement of the seatback 18 between the reclined and non-reclined positions) because if the seat bottom 20 was allowed to move forward relative to the legrest platform 190 when the legrest assembly 16 is in the extended position, the effective length of the legrest assembly would be shortened, which would cause an occupant of the furniture member to adjust the positioning of his or her legs or feet on the legrest platform 190. Since the legrest assembly 16 of the present disclosure is mounted to and movable with the seat bottom 20, no such adjustment of the occupant's legs or feet on the legrest platform is necessary.

While the furniture member 10 is shown in the figures as a chair, it will be appreciated that some or all of the principles of the present disclosure could be incorporated into a sofa, loveseat or other type of furniture member.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A furniture member comprising:

a seat assembly including a seat bottom and a seatback; and a legrest assembly including a legrest platform, a push bar and a pair of articulating arm assemblies, each of the articulating arm assemblies including a first link-housing, a second link-housing, a first control link, and a second control link;

the first link-housings are fixedly attached to the push bar and are rotatably attached to the seat bottom;

each of the second link-housings is rotatably attached to a respective one of the first link-housings, the second link-housings are rotatably attached to the legrest platform;

each of the first control links is disposed within a respective one of the first link-housings, wherein rotation of the first link-housings relative to the seat bottom causes relative movement between the first control links and the first link-housings and relative movement between the first control links and the second link-housings; and each of the second control links is disposed at least partially within a respective one of the second link-housings, the second control links are movably coupled to the second link-housings and movably coupled to the legrest platform.

2. The furniture member of claim 1, wherein the seat assembly includes armrest members, the seat bottom is disposed between the armrest members and is movable relative to the armrest members, and wherein a distance between the legrest platform and a front frame member of the seat bottom does not change in response to movement of the seat bottom relative to the armrest members.

3. The furniture member of claim 2, wherein the distance between the legrest platform and the front frame member of the seat bottom does not change in response to movement of the seatback relative to the armrest members and the seat bottom.

4. The furniture member of claim 2, wherein the legrest assembly is mounted to the seat bottom such that the entire legrest assembly is allowed to move with the seat bottom relative to the armrest members while remaining fixed relative to the seat bottom.

5. The furniture member of claim 2, further comprising a base assembly supporting the seat assembly, wherein the seat bottom is movable relative to the base assembly, and wherein the distance between the legrest platform and the front frame member of the seat bottom does not change in response to movement of the seat bottom relative to the base assembly.

6. The furniture member of claim 1, wherein each of the first control links are rotatably attached to a first lug member that is at least partially disposed within the respective first link-housing, the first lug member being fixed relative to the seat bottom.

7. The furniture member of claim 6, wherein each of the first control links are rotatably attached to a second lug member that is at least partially disposed within the respective first link-housing, the second lug member being fixed relative to the respective second link-housing.

8. The furniture member of claim 7, wherein each first link-housing includes a first joint-bearing-surface that encircles the respective second lug member, wherein each second link-housing includes a second joint-bearing-surface that encircles the respective second lug member and rotatably engages the first joint-bearing surface, and wherein the first and second joint-bearing-surfaces are flat surfaces that cooperate with each other to restrict side-to-side movement of the legrest assembly relative to the seat assembly.

9. The furniture member of claim 8, wherein the first link-housing includes a third joint-bearing-surface that encircles a rotational axis about which the first link-housing rotates relative to a seat attachment bracket fixed to the seat bottom.

10. The furniture member of claim 1, wherein one end of each second control link is rotatably attached to a platform bracket that is fixed to the legrest platform.

11. The furniture member of claim 10, wherein another end of each second control link includes a pin that is slidably received in an arcuate slot formed in the respective second link-housing.

12. The furniture member of claim 11, wherein the arcuate slot curves partially around a rotational axis about which the second link-housing rotates relative to the first link-housing.

13. The furniture member of claim 1, wherein the first link-housings are rotatably attached to seat attachment brackets fixedly mounted on a front frame member of the seat bottom.

14. The furniture member of claim 13, wherein each seat attachment bracket is coupled to a first lug member by a first keyed shaft, wherein the first control link is rotatably attached to the first lug member and a second lug member, wherein the second lug member is rotationally fixed to a joint plate fixed to the second link-housing, and wherein torque applied to the first link-housing is transmitted to the second link-housing through the first control link and the second keyed shaft.

15. The furniture member of claim 13, wherein the legrest assembly includes a legrest actuator rotatably coupled at a first end to the push bar and rotatably coupled at a second end to a rear frame member of the seat bottom.

16. The furniture member of claim 15, wherein one end of each second control link is rotatably attached to a platform bracket that is fixed to the legrest platform, and wherein torque is transmitted to the platform bracket when the legrest actuator applies a force to the push bar.

17. The furniture member of claim 16, wherein the platform bracket moves translationally and rotationally as the legrest assembly moves relative to the seat assembly between a retracted position and an extended position.

18. The furniture member of claim 15, wherein the legrest actuator is coupled to the rear frame member of the seat bottom by a compliant bracket assembly, the compliant bracket assembly allowing linear movement of the second end of the legrest actuator relative to the rear frame member.

19. The furniture member of claim 18, wherein the compliant bracket assembly includes a tube, a bar and a spring, wherein one end of the spring is fixed relative to the tube and another end of the spring is fixed relative to the bar, wherein the bar is reciprocatingly received in the tube, wherein one of the tube and the bar is attached to the rear frame member and the other of the tube and the bar is attached to the second end of the legrest actuator.

20. The furniture member of claim 19, wherein the legrest actuator includes a motor, a cylinder, and a piston, wherein the cylinder is rotatably coupled to the push bar, wherein the piston reciprocatingly received in the cylinder and is rotatably coupled to the compliant bracket assembly.

21. A furniture member comprising:

a seat assembly including armrest members, a seat bottom and a seatback, the seat bottom disposed between the armrest members and movable relative to the armrest members;

a base assembly supporting the seat assembly, wherein the seat bottom is movable relative to the base assembly; and a legrest assembly including a legrest platform, a pair of articulating arm assemblies, each of the articulating arm assemblies including a first link-housing and a second link-housing, the first link-housings are rotatably attached to the seat bottom, each of the second link-housings is rotatably attached to a respective one of the first link-housings, the second link-housings are rotatably attached to the legrest platform, wherein the legrest assembly is mounted only to the seat bottom, and the entire legrest assembly is movable with the seat bottom relative to the armrest members and the base assembly while remaining fixed relative to the seat bottom such that a distance between the legrest platform and a front frame member of the seat bottom does not change in response to movement of the seat bottom relative to the armrest members and base assembly.

22. The furniture member of claim 21, wherein the distance between the legrest platform and the front frame member of the seat bottom does not change in response to movement of the seatback relative to the armrest members and the seat bottom.

23. The furniture member of claim 21, wherein each of the articulating arm assemblies includes a first control link and a second control link, wherein each of the first control links is disposed within a respective one of the first link-housings, wherein rotation of the first link-housings relative to the seat bottom causes relative movement between the first control links and the first link-housings and relative movement between the first control links and the second link-housings.

24. The furniture member of claim 23, wherein each of the second control links is disposed at least partially within a respective one of the second link-housings, the second control links are movably coupled to the second link-housings and movably coupled to the legrest platform.

25. The furniture member of claim 24, wherein each of the first control links are rotatably attached to a first lug member that is at least partially disposed within the respective first link-housing, the first lug member being fixed relative to the seat bottom.

26. The furniture member of claim 25, wherein each of the first control links are rotatably attached to a second lug member that is at least partially disposed within the respective first link-housing, the second lug member being fixed relative to the respective second link-housing.

27. The furniture member of claim 26, wherein one end of each second control link is rotatably attached to a platform bracket that is fixed to the legrest platform.

28. The furniture member of claim 27, wherein another end of each second control link includes a pin that is slidably received in an arcuate slot formed in the respective second link-housing.

29. The furniture member of claim 28, wherein the arcuate slot curves partially around a rotational axis about which the second link-housing rotates relative to the first link-housing.

30. The furniture member of claim 21, wherein the first link-housings are rotatably attached to brackets fixedly mounted on the front frame member of the seat bottom.

31. The furniture member of claim 30, wherein the legrest assembly includes a push bar fixedly attached to the first link-housings and a legrest actuator rotatably coupled at a first end to the push bar and rotatably coupled at a second end to a rear frame member of the seat bottom.

32. The furniture member of claim 31, wherein the legrest actuator is coupled to the rear frame member of the seat bottom by a compliant bracket assembly, the compliant bracket assembly allowing linear movement of the second end of the legrest actuator relative to the rear frame member.

33. The furniture member of claim 32, wherein the compliant bracket assembly includes a tube, a bar and a spring, wherein one end of the spring is fixed relative to the tube and another end of the spring is fixed relative to the bar, wherein the bar is reciprocatingly received in the tube, wherein one of the tube and the bar is attached to the rear frame member and the other of the tube and the bar is attached to the second end of the legrest actuator.

34. The furniture member of claim 33, wherein the legrest actuator includes a motor, a cylinder, and a piston, wherein the cylinder is rotatably coupled to the push bar, wherein the piston reciprocatingly received in the cylinder and is rotatably coupled to the compliant bracket assembly.

* * * * *